US009442429B2

(12) United States Patent
Ueda et al.

(10) Patent No.: US 9,442,429 B2
(45) Date of Patent: Sep. 13, 2016

(54) IMAGE FORMING APPARATUS AND METHOD OF SWITCHING COLLECTED DEVELOPER ROUTE IN IMAGE FORMING APPARATUS

(71) Applicants: Tetsuto Ueda, Kanagawa (JP); Hiroomi Tamura, Kanagawa (JP); Kazuya Saitoh, Kanagawa (JP); Sho Sekiguchi, Tokyo (JP); Hirokatsu Suzuki, Kanagawa (JP); Takeshi Kojima, Kanagawa (JP); Takuma Iwasaki, Tokyo (JP); Taichi Urayama, Kanagawa (JP)

(72) Inventors: Tetsuto Ueda, Kanagawa (JP); Hiroomi Tamura, Kanagawa (JP); Kazuya Saitoh, Kanagawa (JP); Sho Sekiguchi, Tokyo (JP); Hirokatsu Suzuki, Kanagawa (JP); Takeshi Kojima, Kanagawa (JP); Takuma Iwasaki, Tokyo (JP); Taichi Urayama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/810,909

(22) Filed: Jul. 28, 2015

(65) Prior Publication Data

US 2016/0041504 A1 Feb. 11, 2016

(30) Foreign Application Priority Data

Aug. 7, 2014 (JP) ..... 2014-161487

(51) Int. Cl.
*G03G 21/00* (2006.01)
*G03G 15/095* (2006.01)

(52) U.S. Cl.
CPC ..... *G03G 15/095* (2013.01)

(58) Field of Classification Search
CPC ..... G03G 19/095; G03G 15/095
USPC ..... 399/359
See application file for complete search history.

(56) References Cited

U.S. PATENT DOCUMENTS

2005/0232669 A1* 10/2005 Ishikawa ..... G03G 21/12 399/358
2012/0003016 A1* 1/2012 Uchiyama ..... G03G 15/0131 399/301

(Continued)

FOREIGN PATENT DOCUMENTS

JP 2002-072808 3/2002
JP 2005-308861 11/2005

OTHER PUBLICATIONS

U.S. Appl. No. 14/622,213, filed Feb. 13, 2015.

*Primary Examiner* — David Bolduc
*Assistant Examiner* — Barnabas Fekete
(74) *Attorney, Agent, or Firm* — Harness, Dickey & Pierce, P.L.C.

(57) ABSTRACT

An image forming apparatus includes an image bearer; a developing device; a transfer device; a waste-developer container; a developer collecting device including a collected-developer conveyor, a waste channel, a reuse channel, and a channel switching member to switch a route between the waste channel and the reuse channel; a switching determiner to determine whether to dispose or reuse collected developer; an operating condition data collector to collect and store operating condition data used as a degradation speed index of developer in the developing device; a determination type selector to select, according to the degradation speed index, one of a first determination type based on an operating amount and a second determination type based on developer replacement data indicating an amount of developer replaced with supplied developer in the developing device; and a switching controller to control the channel switching member according to determination made by the switching determiner.

20 Claims, 16 Drawing Sheets

(56) References Cited

U.S. PATENT DOCUMENTS

2013/0028625 A1* 1/2013 Ando ..... G03G 15/0189 399/72
2014/0341597 A1 11/2014 Urayama et al.
2014/0348521 A1 11/2014 Mase et al.
2015/0117884 A1 4/2015 Sugiyama et al.
2015/0139668 A1 5/2015 Sugiyama et al.
2015/0139674 A1 5/2015 Sugiyama et al.

* cited by examiner

| TIME | 9 | 10 | 11 | 12 | 13 | 14 | 15 | 16 | 17 | 18 | AVERAGE |
|---|---|---|---|---|---|---|---|---|---|---|---|
| TEMPER-ATURE (°C) | 28.0 | 33.0 | 37.0 | 37.0 | 38.0 | 37.0 | 37.0 | 38.0 | 37.0 | 37.0 | 35.9 |

| NUMBER OF SHEETS | 0 TO 500 | TO 1000 | TO 1500 | TO 2000 | TO 2500 | TO 3000 | TO 3500 | TO 4000 | TO 4500 | TO 5000 | AVERAGE |
|---|---|---|---|---|---|---|---|---|---|---|---|
| SMOOTH-NESS | 60.0 | 40.0 | 20.0 | 30.0 | 25.0 | 40.0 | 25.0 | 30.0 | 20.0 | 50.0 | 34.0 |

FIG. 10A

TEMPERATURE INSIDE APPARATUS : ≥ 35°C
HUMIDITY INSIDE APPARATUS : ≥ 70% → DETERMINATION TYPE A

TEMPERATURE INSIDE APPARATUS : < 35°C
HUMIDITY INSIDE APPARATUS : < 70% → DETERMINATION TYPE B

FIG. 10B

NUMBER OF PRINTED SHEETS PER DAY IN PRECEDING THREE DAYS : ≥ 5000 → DETERMINATION TYPE A

NUMBER OF PRINTED SHEETS PER DAY IN PRECEDING THREE DAYS : < 5000 → DETERMINATION TYPE B

FIG. 10C

ACCUMULATED NUMBER OF PRINTED SHEETS : ≥ 40,000 → DETERMINATION TYPE A

ACCUMULATED NUMBER OF PRINTED SHEETS : < 40,000 → DETERMINATION TYPE B

FIG. 10D

DUPLEX PRINTING : ≥ 30% → DETERMINATION TYPE A

DUPLEX PRINTING : < 30% → DETERMINATION TYPE B

FIG. 10E

UNUSED TIME (IN MINUTE) : < 30 → DETERMINATION TYPE A

UNUSED TIME (IN MINUTE) : ≥ 30 → DETERMINATION TYPE B

FIG. 10F

AVERAGE SMOOTHNESS : < 30 → DETERMINATION TYPE A

AVERAGE SMOOTHNESS : ≥ 30 → DETERMINATION TYPE B

IMAGE FORMING APPARATUS AND METHOD OF SWITCHING COLLECTED DEVELOPER ROUTE IN IMAGE FORMING APPARATUS

CROSS-REFERENCE TO RELATED APPLICATIONS

This patent application is based on and claims priority pursuant to 35 U.S.C. §119(a) to Japanese Patent Application No. 2014-161487, filed on Aug. 7, 2014, in the Japan Patent Office, the entire disclosure of which is hereby incorporated by reference herein.

BACKGROUND

1. Technical Field

Embodiments of the present invention generally relate to an image forming apparatus, such as a copier, a printer, a facsimile machine, or a multifunction peripheral (i.e., a multifunction machine) having at least two of copying, printing, facsimile transmission, plotting, and scanning capabilities, and a method of switching a collected developer route in an image forming apparatus.

2. Description of the Related Art

At present, image forming apparatuses such as printers and facsimile machines to output electronic data and copiers to copy documents are widely used. There are image forming apparatuses that employ electrophotography.

Electrophotographic image forming apparatuses form an electrostatic latent image on an image bearer, such as a photoconductor drum, develop the latent image with developer such as toner into a toner image, and transfer the toner image on a sheet of recording media. When the toner image is transferred from the image bearer onto the sheet, a certain amount of toner remains on the image bearer. Accordingly, after image formation, such toner is removed by a cleaning device and collected in a waste-toner container. The collected toner may be still usable. Disposing the still usable toner is not desirable from the viewpoint of environment conservation and running cost. Additionally, replacement frequency of the waste-toner container increases, thus making the maintenance and management of the apparatus more complicated.

Therefore, reuse of developer collected from the image bearer has been proposed. Reuse of collected developer is preferable since the amount of images produced with an identical amount of developer increases and the amount of waste developer is reduced.

Typical developer used in electrophotographic image forming apparatuses, however, is degraded while being exposed to heat, humidity, and outside air. Developer is also degraded by friction with a developer conveying mechanism, such as a developer conveying screw. Therefore, developer supplied from an isolated developer bottle to the developing device is gradually degraded with time. The degradation progresses in proportional to increases in the amount of driving of the developer conveying mechanism.

Depending on the degree of degradation, image quality is affected. For example, images become smeary, or toner is partly absent in the images. Although reuse of developer can reduce environmental impact, running cost of the apparatus, replacement frequency of waste-toner containers, it makes difficult to guarantee image quality since degraded developer is reused.

Thus, there is trade-off between advantages of reuse of developer and image quality guarantee.

To balance the advantages of reused of developer and image quality preservation, handling of collected developer may be switched between reuse and disposal.

SUMMARY

An embodiment of the present invention provides an image forming apparatus that includes an image bearer to bear a latent image, a developing device to develop the latent image with developer, a transfer device to transfer a developed image from the image bearer onto a recording medium, a waste-developer container to contain developer to be disposed, a developer collecting device to collect developer from the image bearer, a switching determiner to determine whether to dispose or reuse collected developer, an operating condition data collector to collect and store operating condition data used as a degradation speed index of developer in the developing device, a determination type selector to select a determination type used in determination of whether to dispose or reuse the collected developer, and a switching controller to control switching between dispose and reuse of the collected developer.

The developer collecting device includes a collected-developer conveyor to transport the collected developer collected from the image bearer in the developer collecting device, a waste channel leading to the waste-developer container, a reuse channel through which the collected developer for reuse is transported, and a channel switching member to switch a collected developer route between the waste channel and the reuse channel. According to the degradation speed index collected by the operating condition data collector, the determination type selector selects one of a first determination type based on an operating amount of the image forming apparatus, and a second determination type based on developer replacement data indicating an amount of developer replaced with supplied developer in the developing device. The switching controller controls the channel switching member according to determination made by the switching determiner.

Another embodiment provides a method of switching a collected developer route in an image forming apparatus. The method includes collecting developer from an image bearer; selecting, according to a degradation speed index indicating a degradation speed of developer in a developing device, a determination type used in determination of whether to dispose or reuse the collected developer from a first determination type based on an operating amount of the image forming apparatus, and a second determination type based on developer replacement data indicating an amount of developer replaced with supplied developer in the developing device; and determining whether to dispose or reuse the collected developer in the determination type selected.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 10A through 10F are charts of examples of criteria for operating conditions when a determination type according to an embodiment is selected;

DETAILED DESCRIPTION

Figure 1:
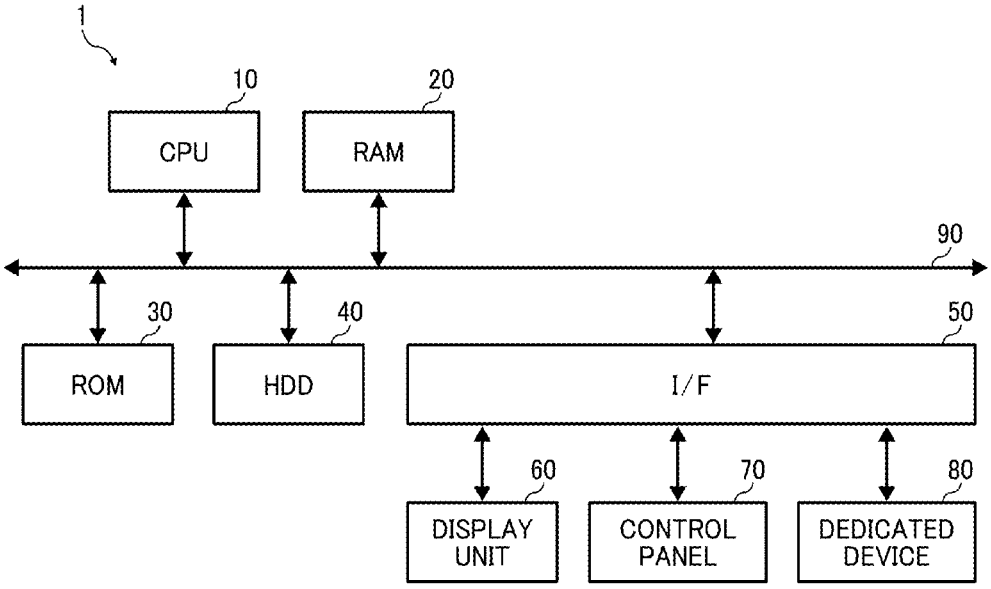
FIG. 1 is a schematic block diagram of a hardware configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

First Embodiment

A first embodiment is described below using an electrophotographic image forming apparatus that forms electrostatic latent images on an image bearer such as a photoconductor drum with laser beams, supplies charged developer such as toner to the latent image, thereby developing the latent image into a toner image, transfers the toner image onto a sheet of recording media, and fixes the toner image on the sheet by heating and pressing the sheet.

After image formation, developer (i.e., toner) remaining on the image bearer is removed. As described above, after the toner image is transferred from the image bearer onto the sheet, a certain amount of toner remains on the image bearer and collected by a cleaning device. In the embodiments described below, handling of developer collected from the image bearer is switched between disposal and reuse.

It is possible that whether to dispose or reuse developer collected from the image bearer is determined improperly. For example, the image forming apparatus may determine to reuse the collected developer that has degraded to lower image quality to an unacceptable level and may determine to dispose the collected developer that is still usable, that is, the degradation degree of the collected developer does not result in the degradation of image quality.

In view of the foregoing, in the first embodiment, switching between disposal and reuse of collected developer is determined based on either toner replacement data or operating amount of the apparatus such as the number of sheets printed. The toner replacement data relates to consumption of toner in a developing device and supply of toner to the developing device.

When the switching between disposal and reuse of collected developer is determined based on the toner replacement data, degradation of toner caused by long time agitation (stirring) in the developing device can be inhibited, and the amount of waste toner can be reduced.

By contrast, when the switching between disposal and reuse of collected developer is determined based on the operating amount, degradation of toner caused by harsh operating conditions, such as hot and humid conditions, can be inhibited, and the amount of waste toner can be reduced. It is to be noted that, at that time, degradation of toner quality resulting from reused toner is inhibited since the image forming apparatus according to the present embodiment actively reduces the content of reused toner in the developing device.

In the image forming apparatus having the above-described structure, based on operating condition data (i.e., a degradation speed index), either the toner replacement data or the operating amount is selected as the switching trigger for switching between disposal and reuse of collected developer.

Specifically, when it is determined that the operating condition satisfies a predetermined criterion based on the operating condition data, it is determined that the image forming apparatus is under harsh conditions, and switching between disposal and reuse of collected developer is controlled based on the operating amount.

By contrast, when the operating condition does not satisfy the predetermined criterion based on the operating condition data, it is determined that the operating condition is not harsh, and switching between disposal and reuse of collected developer is controlled based on the toner replacement data.

With this configuration, handling of collected developer is properly switched between disposed and reused. Accordingly, both of advantages of reuse of developer, such as reductions of environmental impact, running cost of the apparatus, and complexity of maintenance and management, and image quality guarantee are attained.

Referring now to the drawings, wherein like reference numerals designate identical or corresponding parts throughout the several views thereof, and particularly to FIG. 1, an image forming apparatus 1 according to an embodiment of the present invention is described.

Initially, descriptions are given below of a hardware configuration of the image forming apparatus 1 with reference to FIG. 1.

FIG. 1 is a schematic block diagram of the hardware configuration of the image forming apparatus 1 according to the present embodiment.

It is to be noted that, in addition to the hardware configuration illustrated in FIG. 1, the image forming apparatus 1 includes an engine to realize capabilities of printing, scanning, facsimile transmission, and facsimile reception.

As illustrated in FIG. 1, the image forming apparatus 1 according to the present embodiment has a configuration similar to that of typical servers and computers. That is, the image forming apparatus 1 includes a central processing unit (CPU) 10, a random access memory (RAM) 20, a read only memory (ROM) 30, a hard disk drive (HDD) 40, and an interface (I/F) 50, which are connected to each other via a bus 90. To the interface 50, further a display unit 60, a control panel 70, and dedicated devices 80 are connected.

The CPU 10 is a computation device and controls actions of the entire image forming apparatus 1. The RANI 20 is a volatile storage medium (memory) capable of high-speed data reading and writing. The RAM 20 is used as workspace when the CPU 10 processes data. The ROM 30 is a non-volatile storage medium (memory) dedicated to reading out and stores programs such as firmware. The HDD 40 is a non-volatile storage medium capable of data reading and writing, and an operating system (OS), various types of control programs, application programs, and the like are stored therein.

The interface 50 connects the bus 90 to the various types of hardware and networks and controls the bus 90, the hardware, and the networks. The display unit 60 is a visual user interface for users to check a status of the image forming apparatus 1 and is realized by a display such as a liquid crystal display (LCD). The control panel 70 is a user interface for users to input data to the image forming apparatus 1 and includes a keyboard, a mouse, and the like. The dedicated devices 80 are hardware to realize dedicated capabilities of printing, scanning, fax transmission, and fax reception.

In the above-described hardware configuration, the CPU 10 executes computation according to programs loaded in the RAM 20 from the ROM 30, the HDD 40, or recording media such as optical disk. Then, control software is implemented. With the implement control software and the above-described hardware configuration, a function block for the capabilities of the image forming apparatus 1 is configured.

Next, descriptions are given below of a functional configuration of the image forming apparatus 1 according to the present embodiment with reference to FIG. 2.

Figure 2:
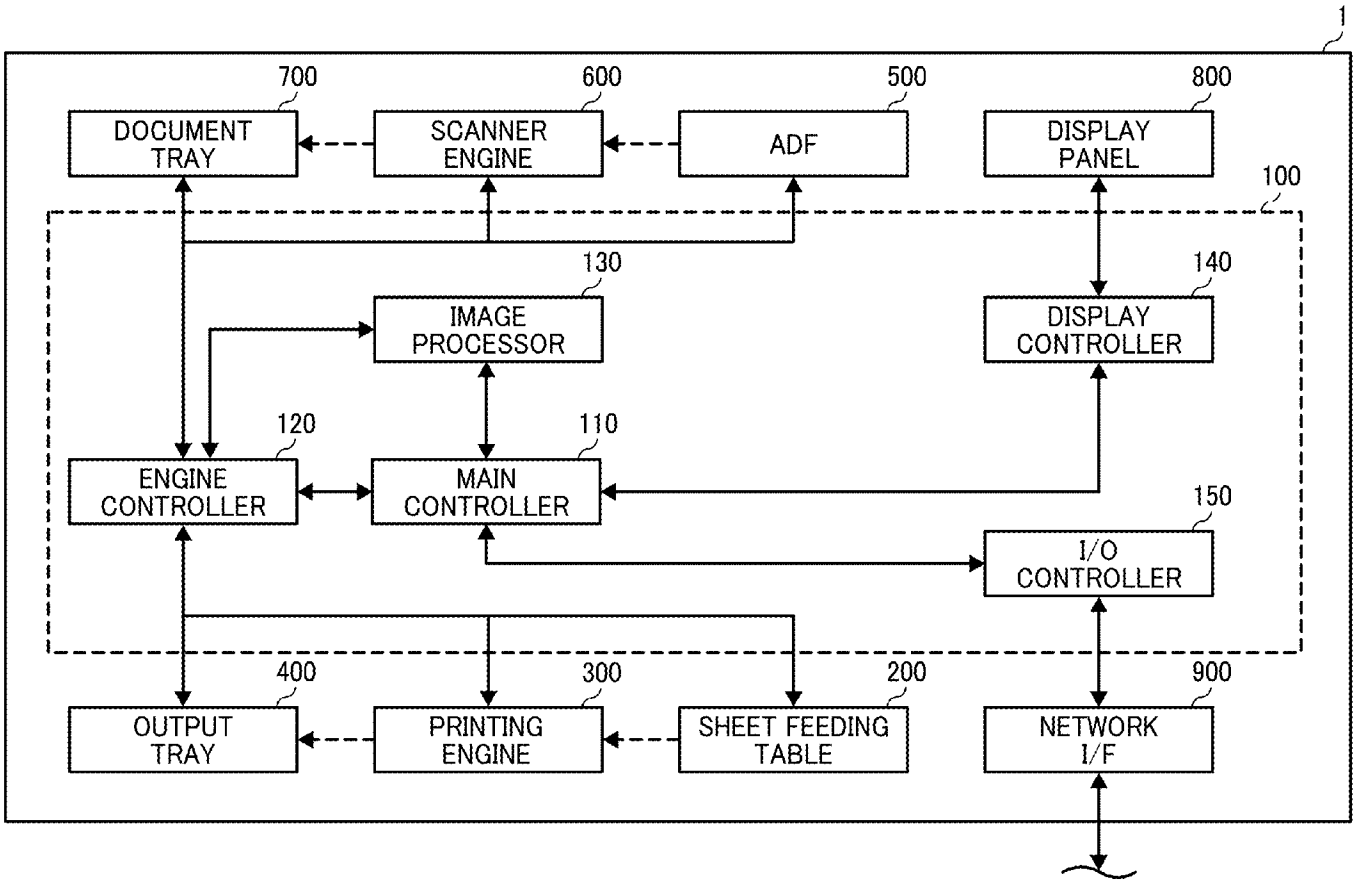
FIG. 2 is a schematic block diagram of a functional configuration of an image forming apparatus according to an embodiment.

FIG. 2 is a schematic block diagram of the functional configuration of the image forming apparatus 1. It is to be noted that, in FIG. 2, solid liens represent electrical connections, and broken lines represent flow of recording sheets or documents.

In the configuration illustrated in FIG. 2, the image forming apparatus 1 includes a controller 100, a sheet feeding table 200, a printing engine 300, an output tray 400, an automatic document feeder (ADF) 500, a scanner engine 600, a document tray 700, a display panel 800, and a network interface (I/F) 900. The controller 100 includes a main controller 110, an engine controller 120, an image processor 130, a display controller 140, and an input/output (I/O) controller 150.

The sheet feeding table 200 feeds sheets of recording media to the printing engine 300. The printing engine 300 outputs images on the sheets transported from the sheet feeding table 200. In the present embodiment, the printing engine 300 is an image forming unit that employs electrophotography or inkjet image formation. After the printing engine 300 forms an image thereon, the sheet is ejected to the output tray 400. The printing engine 300 is implemented by the dedicated device 80 illustrated in FIG. 1.

The ADF 500 automatically transports documents set on a document table to the scanner engine 600. The scanner engine 600 is a document reading device that includes a photoelectric conversion element to convert optical data into electric signals. The scanner engine 600 optically scans the document transported by the ADF 500 or set on an exposure glass (i.e., a document table) and generates image data. The document is ejected to the document tray 700 after being read by the scanner engine 600. The ADF 500 and the scanner engine 600 are implemented by the dedicated device 80 illustrated in FIG. 1.

The display panel 800 serves as both of an output interface to visually display the state of the image forming apparatus 1 and an input interface such as a touch panel for users to directly operate the image forming apparatus 1 or input data into the image forming apparatus 1. That is, the display panel 800 is capable of displaying images to be operated by the users. The display panel 800 is implemented by the display unit 60 and the control panel 70 illustrated in FIG. 1.

The network interface 900 is an interface for the image forming apparatus 1 to communicate with other devices such as administrator terminals and computers. Examples usable as the network interface 900 include Ethernet®, USB (Universal Serial Bus) interface, Bluetooth®, Wi-Fi® (Wireless Fidelity), and FeliCa®. The image forming apparatus 1 according to the present embodiment thus receives image data and commands such as print request from the terminals connected thereto via the network interface 900. The network interface 900 is implemented by the interface 50 illustrated in FIG. 1.

The controller 100 is configured by a combination of software and hardware. Specifically, the controller 100 is constructed with hardware such as integrated circuits and the control software implemented by the CPU 10 performing the control programs such as firmware loaded from the non-volatile memories, such as the ROM 30 and the HDD 40, to the RAM 20. The controller 100 controls the image forming apparatus 1 entirely.

The main controller 110 controls, that is, gives commands to, respective units of the controller 100. The main controller 110 controls the I/O controller 150 and accesses other devices via the network interface 900 and networks. The engine controller 120 controls or drives components such as the sheet feeding table 200, the printing engine 300, the output tray 400, the ADF 500, the scanner engine 600, the document tray 700, and the like.

The image processor 130 is governed by the main controller 110 and generates drawing data, as output data, according to image data written by PDL (Page Description Language) such as document data or image data included in input print jobs. For example, the drawing data includes bitmap data of cyan (C), magenta (M), yellow (Y), and black (B), according to which the printing engine 300 draws images in image formation.

Additionally, the image processor 130 processes captured images input from the scanner engine 600 and generates image data. The image data is stored as scanning results in the image forming apparatus 1 or transmitted via the network interface 900 or networks to other devices. It is to be noted that, in the present embodiment, instead of image data, drawing data may be directly input to the image forming apparatus 1 so that the image forming apparatus 1 outputs images according to the drawing data.

The display controller 140 displays data on the display panel 800 or reports the input data to the main controller 110 via the display panel 800. The I/O controller 150 inputs signals and commands received via the network interface 900 and networks to the main controller 110.

Next, descriptions are given below of the printing engine 300 according to the present embodiment with reference to FIG. 3.

Figure 3:
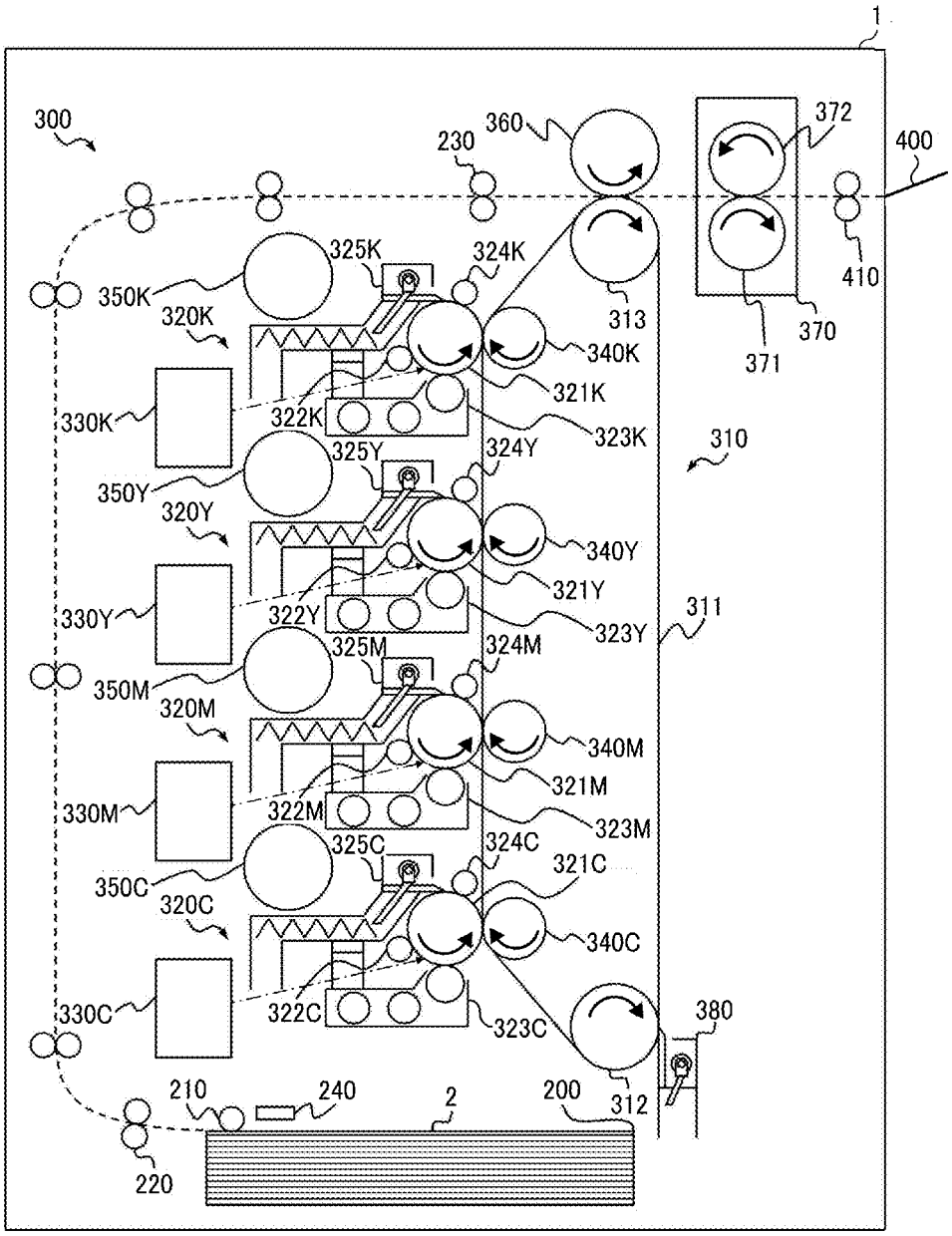
FIG. 3 is a schematic entire view of an image forming apparatus according to an embodiment.

FIG. 3 is a schematic entire view of the image forming apparatus 1 according to the present embodiment. In the configuration illustrated in FIG. 3, the printing engine 300 forms an image on a sheet 2 fed from the sheet feeding table 200, and then the sheet 2 is ejected to the output tray 400.

Additionally, in the configuration illustrated in FIG. 3, the printing engine 300 includes image forming units 320 (320C, 320M, 320Y, and 320K) for respective colors, arranged along an endless conveyor 310, which is a configuration generally called "tandem type". Specifically, in the printing engine 300, along a conveyor belt 311 looped around a driving roller 312 and a driven roller 313, the image forming units 320C, 320M, 320Y, and 320K are arranged in that order in a direction in which the conveyor belt 311 transports the sheet 2.

The multiple image forming units 320C, 320M, 320Y, and 320K are different in the color of toner used therein, but interior structures thereof are similar. The image forming units 320C, 320M, 320Y, and 320K form cyan, magenta, yellow, and black images, respectively. Accordingly, only the image forming unit 320C is described in detail below, and descriptions of components of the image forming units 320M, 320C, and 320K, given subscripts "M", "C", and "K" instead of "C" in the drawings, are omitted.

The conveyor belt 311 looped around the driving roller 312 and the driven roller 313 is an intermediate transfer belt, and the image forming units 320C, 320M, 320Y, and 320K respectively form intermediate transfer images on the conveyor belt 311. A driving motor rotates the driving roller 312. The driving motor, the driving roller 312, and the driven roller 313 together rotate the conveyor belt 311.

The image forming unit 320C includes a photoconductor drum 321C and components disposed therearound, namely, a charging device 322C, a developing device 323C, a discharger 324C, and a toner collecting device 325C.

The image forming unit 320C forms cyan images on the conveyor belt 311 as follows. In the image forming unit 320C, the charging device 322C charges uniformly the outer circumferential face of the photoconductor drum 321C in the dark, after which an optical writing device 330C directs light corresponding to cyan images to the photoconductor drum 321C, thus forming an electrostatic latent image thereon. The developing device 323C develops the electrostatic latent image with cyan toner, thus developing it into a visible image on the photoconductor drum 321C. In other words, the developing device 323 serves as a developer image forming device.

At a primary transfer position where the photoconductor drum 321C contacts or is closest to the conveyor belt 311, a transfer roller 340C is pressed by a biasing member to the photoconductor drum 321C, thereby transferring the toner image onto the conveyor belt 311. Thus, the cyan toner image (i.e., a cyan intermediate image) is formed on the conveyor belt 311. Specifically, a transfer bias is applied to the transfer roller 340C. With the transfer bias, a transfer electrical field is generated at the primary transfer position between the photoconductor drum 321C and the transfer roller 340C, and the toner image is transferred from the photoconductor drum 321C onto the conveyor belt 311.

After the cyan intermediate image is transferred onto the conveyor belt 311, the toner collecting device 325C collects toner remaining on the outer circumferential face of the photoconductor drum 321C, after which the discharger 324C discharges the outer circumferential face of the photoconductor drum 321C. Then, a preparation for subsequent image formation, such as supply of toner to the developing device 323C from a toner supply assembly 350C including a toner bottle and a toner supply device is executed, and the image forming unit 320C goes standby. A partition shutter 325*j* of the toner collecting device 325 serves as the channel switching member to switch handling of toner collected from the photoconductor drum 321 between disposal and reuse.

An aspect of the present embodiment is determination by a switching determiner 393 in controlling the switching made in the toner collecting device 325. The toner collecting device 325C is described in further detail later with reference to FIGS. 5 and 6.

The cyan toner image on the conveyor belt 311 is then transported to the image forming unit 320M as the conveyor belt 311 is rotated by the driving roller 312 and the driven roller 313. The image forming unit 320M forms a magenta image on the photoconductor drum 321M through image forming processes similar to those executed by the image forming unit 320C, and the magenta toner image is superimposed on the cyan toner image on the conveyor belt 311. Thus, the magenta toner image (i.e., a magenta intermediate image) is formed on the conveyor belt 311. Thus, a bicolor intermediate image of cyan and magenta is formed on the conveyor belt 311.

The bicolor intermediate image on the conveyor belt 311 is transported sequentially to the image forming units 320Y and 320K, where yellow and black toner images are respectively transferred from the photoconductor drums 321Y and 321K and superimposed on the intermediate image on the conveyor belt 311. Thus, a yellow intermediate image and a black intermediate image are formed on the conveyor belt 311. Thus, a full-color intermediate image is formed on the conveyor belt 311.

Meanwhile, the sheets 2 stored in the sheet feeding table 200 are sequentially separated and transported from the top by a sheet feeding roller 210 and a separation roller pair 220 to a registration roller pair 230. After correcting skew of the sheet 2, the registration roller pair 230 transports the sheet 2 to a secondary transfer position, timed to coincide with the conveyance of the conveyor belt 311. At the secondary transfer position, the sheet 2 contacts or approaches most the conveyor belt 311 on the channel through which the sheet 2 is transported.

At the secondary transfer position, a transfer roller 360 is pressed to the driven roller 313 by a biasing member, thereby transferring the toner image from the conveyor belt 311 onto the sheet 2. Thus, an image is formed on the sheet 2. The sheet 2 is further transported to a fixing device 370, where the toner image is fixed on the sheet 2 while the sheet 2 is pressed and heated in the direction perpendicular to the surface of the sheet bearing the toner image (i.e., an image formation surface). Then, a pair of paper ejection rollers 410 ejects the sheet 2 to the output tray 400.

Specifically, the fixing device 370 in the present embodiment includes fixing rollers 371 and 372 that rotate while clamping the sheet 2, thereby transporting and pressing the sheet 2. A heating element is provided inside the fixing roller 371 or at a distance from the fixing roller 371 so that the fixing roller 371 heats the sheet 2. Thus, in the fixing device 370, the fixing rollers 371 and 372 fix the image on the sheet 2 by heating and clamping the sheet 2 in the direction perpendicular to the image formation surface.

The conveyor belt 311 is provided with a belt cleaner 380 including a cleaning blade pressed to the conveyor belt 311 at a position downstream from the secondary transfer position and upstream from the image forming unit 320C in the conveyance direction of the conveyor belt 311. The cleaning blade scrapes off toner adhering to the conveyor belt 311.

Thus, the printing engine 300 in the present embodiment includes the endless conveyor 310, the image forming units 320, the optical writing devices 330, the transfer rollers 340 and 360, the toner supply assemblies 350, the fixing device 370, and the belt cleaner 380. The printing engine 300 further includes an internal controller 390 (illustrated in FIG. 8) to control or drive the respective parts of the printing engine 300. A functional configuration of the internal controller 390 is described later with reference to FIG. 8.

It is to be noted reference numeral 240 in FIG. 3 represents a smoothness sensor to measure the smooth of the sheets 2 as sheet type data.

Figure 4:
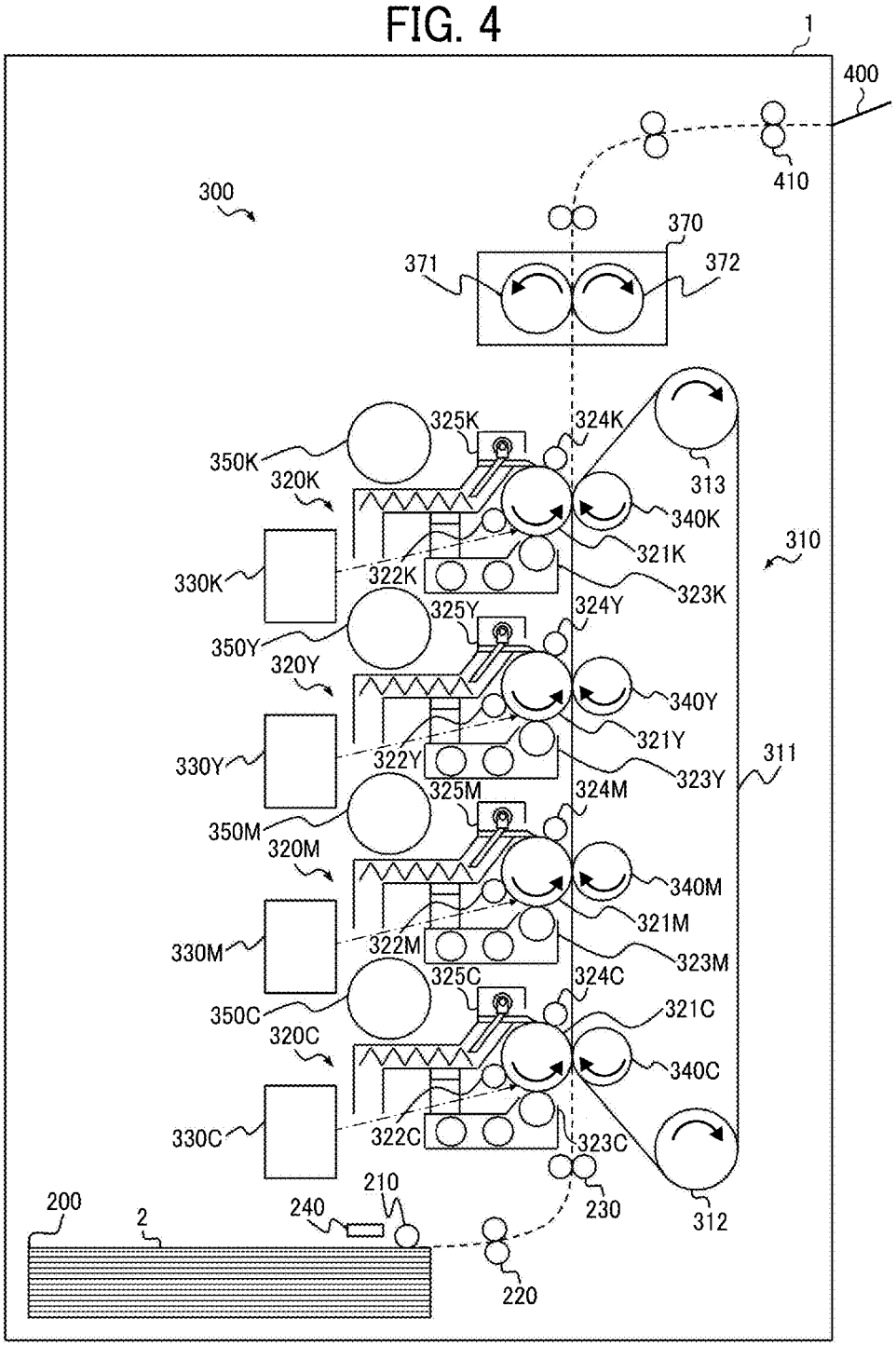
FIG. 4 is a schematic entire view of an image forming apparatus according to another embodiment.

Additionally, although the description above concerns an intermediate transfer (indirect transfer) method, in which the toner image is transferred via the conveyor belt 311 onto the sheet 2, an image forming apparatus according to another embodiment employs a direct transfer method as illustrated in FIG. 4.

Specifically, in the image forming apparatus 1 illustrated in 4, the transfer roller 340 transfers the toner image from the photoconductor drum 321 directly onto the sheet 2 transported by the conveyor belt 311, and the transfer roller 360 and the belt cleaner 380 are not included.

Next, the toner collecting device 325 is described in further detail with reference to FIGS. 5 and 6.

Figure 5:
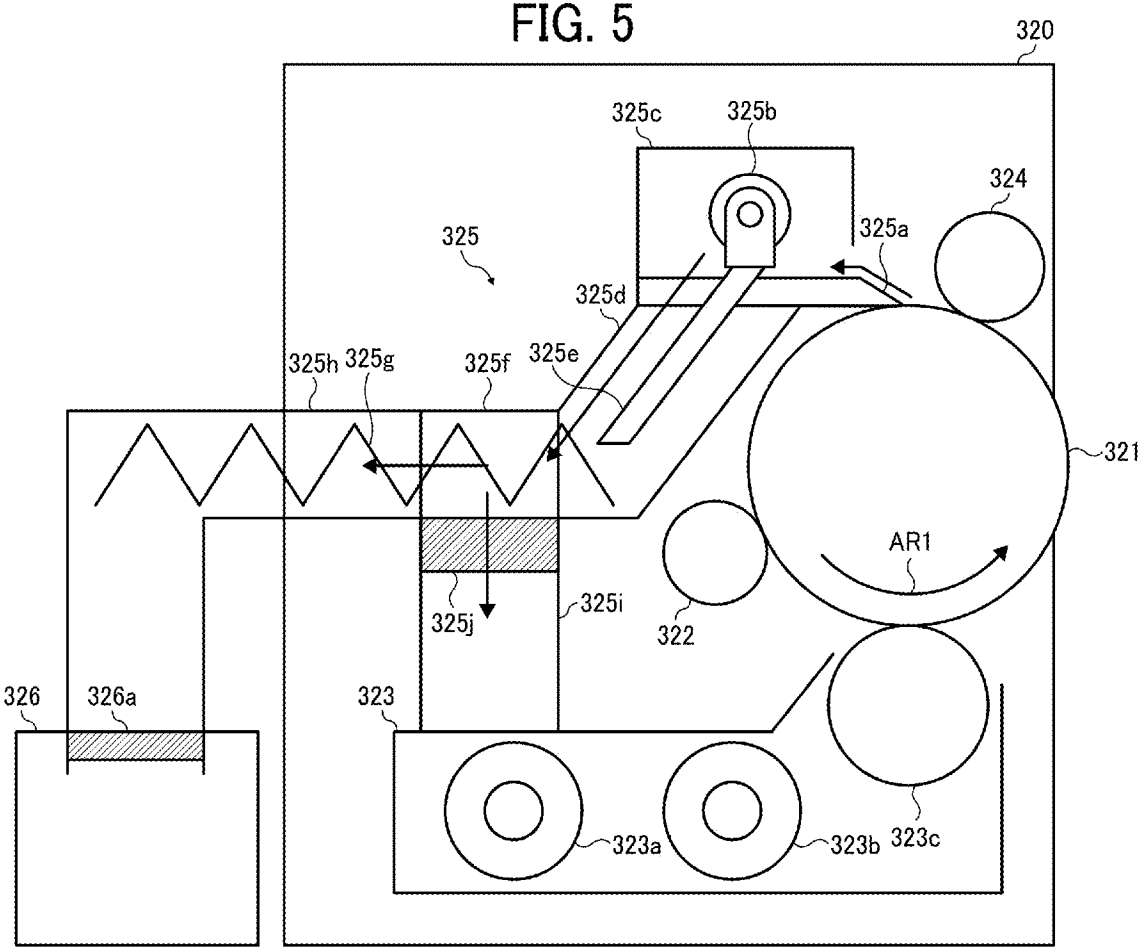
FIG. 5 is a view of an image forming unit according to an embodiment, being a posture installed in the image forming apparatus, as viewed in a main scanning direction.

FIG. 5 is a view of the image forming unit 320 being a posture installed in the image forming apparatus 1, as viewed in a main scanning direction. FIG. 6 is a perspective view of the image forming unit 320 being the posture installed in the image forming apparatus 1, as viewed from above obliquely.

Figure 6:
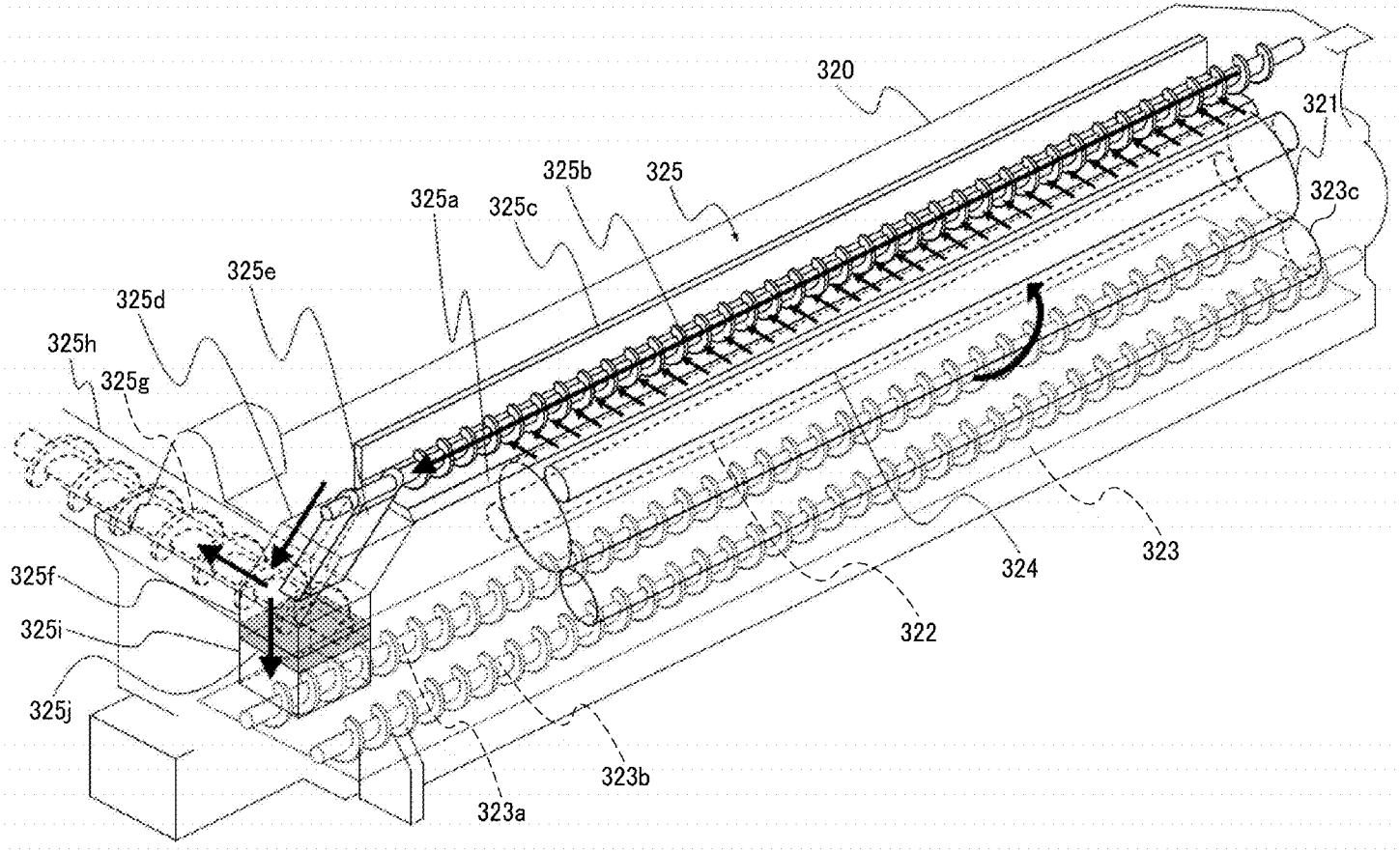
FIG. 6 is a perspective view of the image forming unit being the posture installed in the image forming apparatus, as viewed obliquely from above.

It is to be noted that, since the image forming units 320 are described in detail above with reference to FIG. 3, FIGS. 5 and 6 are used to describe the toner collecting device 325C.

In the configuration illustrated in FIGS. 5 and 6, the toner collecting device 325 includes a cleaning blade 325*a*, a collected-toner conveying screw 325*b*, a toner collecting channels 325*c* and 325*d*, a guide channel 325*e*, a branch portion 325*f*, a screw 325*g*, a waste channel 325*h*, a reuse channel 325*i*, and the partition shutter 325*j* serving as the channel switching member.

The cleaning blade 325*a* is pressed against the outer circumferential face of the photoconductor drum 321, thereby scraping off toner from the photoconductor drum 321 and collecting the toner (hereinafter "collected toner") in the toner collecting channel 325*c*.

The collected-toner conveying screw 325*b* transports the collected toner in the toner collecting channel 325*c* to the toner collecting channel 325*d*. Thus, the collected-toner conveying screw 325*b* serves as a collected-developer conveyor. The collected toner transported by the collected-toner conveying screw 325*b* from the toner collecting channel 325*c* to the toner collecting channel 325*d* is guided by the guide channel 325*e* to the branch portion 325*f*. At the branch portion 325*f*, the toner collecting channel 325*d* branches into the waste channel 325*h* and the reuse channel 325*i*.

The screw 325*g* transports the collected toner through the waste channel 325*h* to a waste-toner container 326 to store waste toner. The collected toner to be disposed is transported through the waste channel 325*h* leading to the waste-toner container 326. The collected toner for reuse is transported through the reuse channel 325*i* leading to the developing device 323.

The partition shutter 325*j* is an openable and closable shutter and disposed in the branch portion 325*f* to partition the waste channel 325*h* from the reuse channel 325*i*. A driver such as a solenoid moves the partition shutter 325*j* between an open position and a close position. The partition shutter 325*j* is closed when the toner collected from the photoconductor drum 321 is disposed without reusing the toner and opened when the toner is reused.

In the toner collecting device 325, toner is scraped off from the photoconductor drum 321 by the cleaning blade 325*a* pressed to the photoconductor drum 321 that is rotating in the direction indicated by arrow AR1 illustrated in FIGS. 5 and 6, and the toner thus scraped off is collected in the toner collecting channel 325*c*.

Then, the toner is transported by the collected-toner conveying screw 325*b* through the toner collecting channel 325*c* to the toner collecting channel 325*d*, where the guide channel 325*e* guides the toner along the toner collecting channel 325*d* to the branch portion 325*f*.

When the collected toner is not for reuse, the partition shutter 325*j* is closed before the collected toner is transported to the branch portion 325*f*. The toner is then transported by the screw 325*g* through the waste channel 325*h* and stored in the waste-toner container 326 as waste toner.

By contrast, to reuse the collected toner (i.e., reused toner), the partition shutter 325*j* is opened before the toner is transported to the branch portion 325*f*. The toner then flows down under the gravity through the reuse channel 325*i* to the developing device 323.

Thus, the partition shutter 325*j* of the toner collecting device 325 serves as the channel switching member to switch the route of collected toner between the between the reuse channel 325*i* and the waste channel 325*h*.

Figure 7:
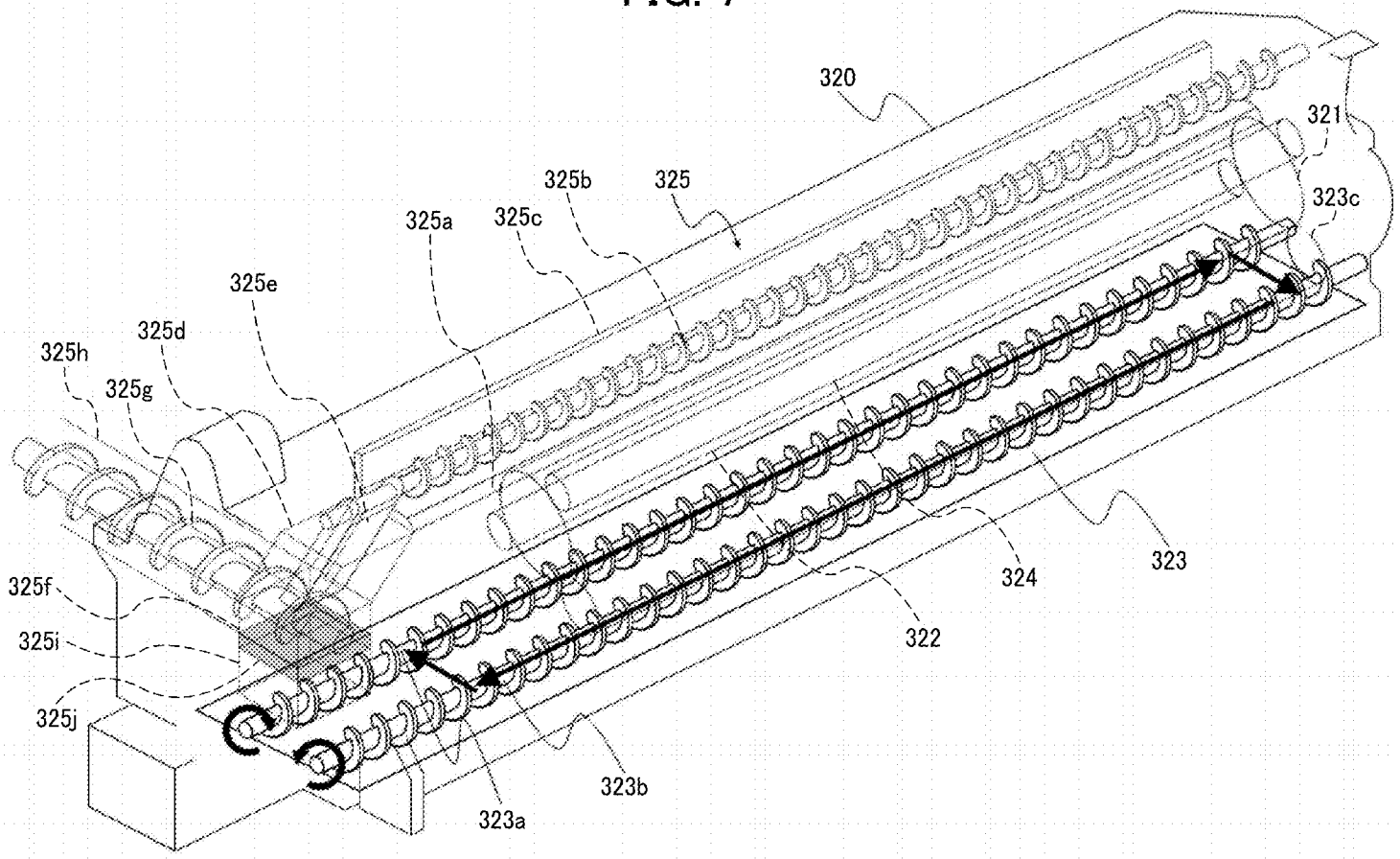
FIG. 7 is a perspective view of the image forming unit being the posture installed in the image forming apparatus, as viewed obliquely from above.

Referring to FIG. 7, the developing device 323 includes developer conveying screws 323*a* and 323*b*, serving as developer conveyors, and a developing roller 323*c* serving as a developer bearer. Examples of the developer conveyors include screws, coils, augers, and paddles. The developer conveying screws 323*a* and 323*b* rotate in the opposite directions, thereby distributing the reused toner entirely in the main scanning direction together with the developer stored in the developing device 323. In image formation, the toner transported by the developer conveying screws 323*a*, and 323*b* is supplied by the developing roller 323*c* to the outer circumferential face of the photoconductor drum 321. Thus, in the present embodiment, the developer conveying screws 323*a* and 323*b* and the developing roller 323*c* are movable components of the developing device 323 driven by a motor. Thus, the collected toner is reused.

Additionally, the waste-toner container 326 includes a toner sensor 326*a* to detect the amount of waste toner in the waste-toner container 326. In the configuration illustrated in FIG. 5, the toner sensor 326*a* is secured at a connection between the waste-toner container 326 and the waste channel 325*h*. In present embodiment, according to detection signals output from the toner sensor 326*a*, the amount of waste toner disposed in the waste-toner container 326 is estimated with a high degree of accuracy.

Next, descriptions are given below of a functional configuration of the internal controller 390 according to the present embodiment.

Figure 8:
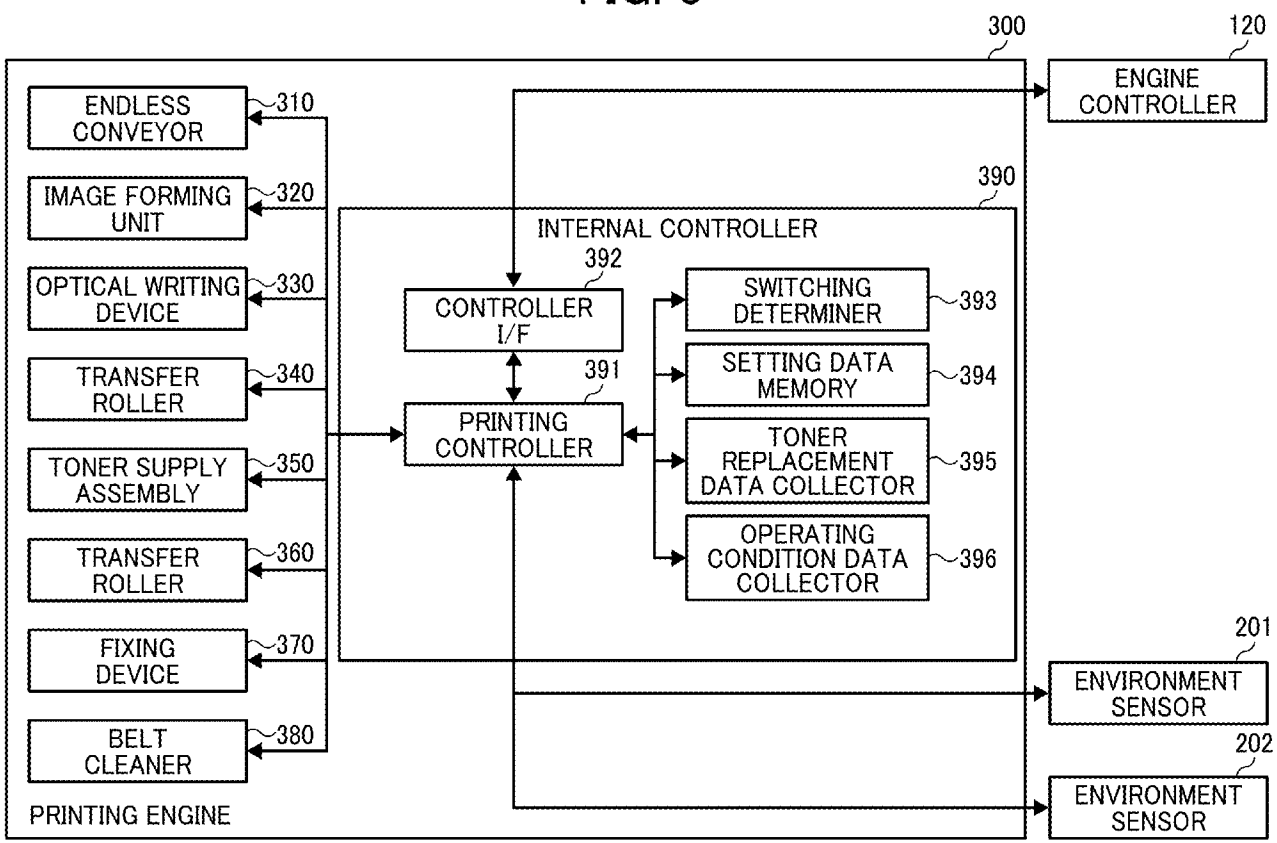
FIG. 8 is a schematic block diagram of a functional configuration of a printing engine according to an embodiment.

FIG. 8 is a schematic block diagram of a functional configuration of the printing engine 300.

As illustrated in FIG. 8, the internal controller 390 according to the present embodiment includes a printing controller 391, a controller interface 392, the switching determiner 393, a setting data memory 394, a toner replacement data collector 395, and an operating condition data collector 396 to collect and store the operating condition data used as the degradation speed index of developer in the developing device 323.

The printing controller 391 controls respective portions of the internal controller 390 and gives commands thereto. Additionally, the printing controller 391 controls or drives the respective portions of the printing engine 300 according to data input from the engine controller 120 via the controller interface 392. Thus, the printing engine 300 acquires data to control or drive the respective portions thereof from the engine controller 120 via the controller interface 392.

The printing controller 391 receives outputs from an environment sensor 201 to detect temperature and humidity inside the apparatus and an environment sensor 202 to detect ambient temperature and ambient humidity The controller interface 392 is an interface for the internal controller 390 to communicate with the engine controller 120.

The switching determiner 393 determines whether to disposal or reuse the toner collected from the photoconductor drum 321 in the toner collecting device 325. At that time, based on the operating condition data, the switching determiner 393 selects one of the toner replacement data (i.e., data on toner consumption and toner supply to the developing device 323) and the operating amount (represented by, for example, the number of printed sheets) as the criterion for switching determination between disposal and reuse of collected toner. Thus, in the present embodiment, the switching determiner 393 serves as a determination type selector. The determination type selection made by the switching determiner 393 is one feature of the present embodiment.

According to the switching determination type selected by the switching determiner 393, the printing controller 391 opens or closes the partition shutter 325*j* (i.e., the channel switching member), thereby switching the route of collected toner in the toner collecting device 325. Thus, the printing controller 391 serves as a switching controller in the present embodiment.

Specifically, when the switching determiner 393 determines that the operating condition satisfies the predetermined criterion based on the operating condition data, the switching determiner 393 determines that the image forming apparatus 1 is under harsh conditions such as hot and humid conditions. Then, the switching determiner 393 selects the number of printed sheets as the criterion for determination of switching between disposal and reuse of collected toner. Hereinafter the determination type based on the number of printed sheets is referred to as "determination type A". In the present embodiment, the determination type A is a first determination type.

Accordingly, the switching determiner 393 according to the present embodiment executes the switching between disposal and reuse of collected toner to balance inhibition of degradation of toner caused by harsh operating conditions and reduction of the amount of waste toner. It is to be noted that, at that time, degradation of toner quality resulting from reused toner is suppressed since the switching determiner 393 according to the present embodiment actively reduces the content of reused toner in the developing device 323.

By contrast, when the switching determiner 393 determines that the operating condition does not satisfy the predetermined criterion according to the operating condition data, the switching determiner 393 selects the toner replacement data as the criterion for the switching between disposal and reuse of collected toner, determining that the operating condition is not harsh. Hereinafter the determination type based on the toner replacement data is referred to as "determination type B". In the present embodiment, the determination type B is a second determination type. Accordingly, the switching determiner 393 according to the present embodiment executes the switching between disposal and reuse of collected toner to balance inhibition of degradation of toner caused by long time agitation in the developing device 323 and reduction of the amount of waste toner.

With this configuration, handling of collected toner is properly switched between disposed and reused. Accordingly, the image forming apparatus 1 according to the present embodiment attains both of advantages of reuse of developer, such as reductions of environmental impact, running cost of the apparatus, and complexity of maintenance and management, and image quality guarantee.

It is to be noted that, in the description below, the term "switching control" means actions made by the switching determiner 393 to control the switching between disposal and reuse of collected toner, and the term "determination type selection" means the actions of the switching determiner 393 to select one of the toner replacement data and the number of printed sheets as the criterion for the switching.

In this specification, the term "toner replacement data" is an index to the degree of degradation of toner in the developing device 323. For example, toner is degraded by being agitated for a long time in the developing device 323.

For example, in the present embodiment, the toner replacement data is at least one of: the driving amount (i.e., rotation speed, rotation distance, driving time, or the like) of a movable component (driven by a motor) disposed in the passage starting from the photoconductor drum 321 and extending into the toner collecting device 325, through which toner moves inside the apparatus, such as the developer conveying screws 323*a* and 323*b*, the developing roller 323*c*, the photoconductor drum 321, and the collected-toner conveying screw 325*b*; the pattern of images to be output (image pattern); the area of images to be output (image area); the amount of toner adhering to the photoconductor drum 321 when an image is output; the amount of toner transferred from the photoconductor drum 321 onto the sheet when an image is output; a transfer rate thereof; the amount of toner supplied to the developing device 323 from the toner supply assembly 350; the time during which toner is supplied from the toner supply assembly 350 to the developing device 323; the amount of toner contained in the waste-toner container 326; the sheet type data indicating a property such as smoothness of the sheet on which an image is formed; and the elapsed time from when toner is supplied from the toner bottle to the developing device 323.

The internal controller 390 has capabilities to obtain the detected, measured, or calculated values listed above and, for example, includes a transfer amount calculator to calculate the transfer amount and transfer rate in each image formation based on the pixel data obtained from the engine controller 120, a time counter to count a given period, a print sheet counter to count the number of printed sheets, and a driving amount measuring portion to measure or calculate the driving amount described above.

Accordingly, the image forming apparatus 1 determines that toner has been agitated for a long time in the developing device 323 based on the toner replacement data, which represents the amount of toner replaced with supplied toner in the developing device 323.

Additionally, the term "operating condition data" is an index to environments in which the image forming apparatus 1 is used (i.e., operating environments) or operating conditions of the image forming apparatus 1. That is, the operating condition data is a degradation speed index to indicate a degradation speed of toner in the developing device 323.

For example, in the present embodiment, the operating condition data is at least one of: temperature inside the apparatus in the operating environments; temperature outside the apparatus in the operating environments (ambient temperature); humidity inside the apparatus in the operating environments; humidity outside the apparatus in the operating environments (ambient humidity); number of printed sheets per unit time; the driving amount (such as the number of rotations, rotation distance, driving time, or the like) per unit time of the developer conveying screws 323*a* and 323*b*, the developing roller 323*c*, and the photoconductor drum 321; the accumulated number of printed sheets; the accumulated driving amount (such as the accumulated number of rotations, accumulated rotation distance, accumulated driving time, or the like) of the developer conveying screws 323*a* and 323*b*, the developing roller 323*c*, and the photoconductor drum 321; the rate of duplex printing; the length of time the apparatus is left unused (i.e., unused time) from the previous operation; sheet type data indicating a property such as smoothness of the sheet on which an image is formed; and the like.

Thus, the image forming apparatus 1 determines that the operating conditions are harsh based on the operating condition data, which is the index to the degradation speed of toner in the developing device 323.

For example, the operating condition data is either the operating condition data at the time of switching determination made by the switching determiner 393 or an average of operating condition data in a given period. In a case where the operating condition data is the average of operating condition data in a given period, a history of operating condition data is stored in the non-volatile storage medium such as the HDD 40 in the present embodiment.

FIGS. 9A through 9D are tables and graphs of examples of the history of operating condition data and an average of the operating condition data stored in the image forming apparatus 1.

Figures 9A, 9B:
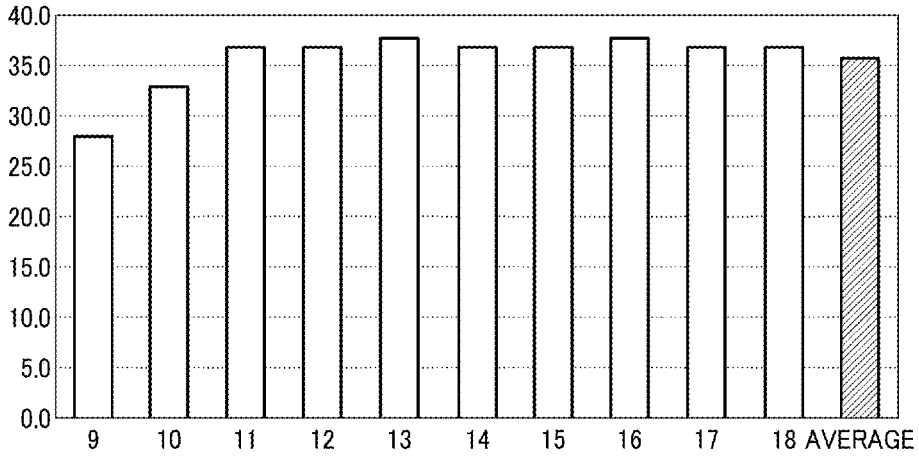
FIGS. 9A, 9B, 9C, and 9D are tables and graphs of operating condition data according to an embodiment.
Figures 9C, 9D:
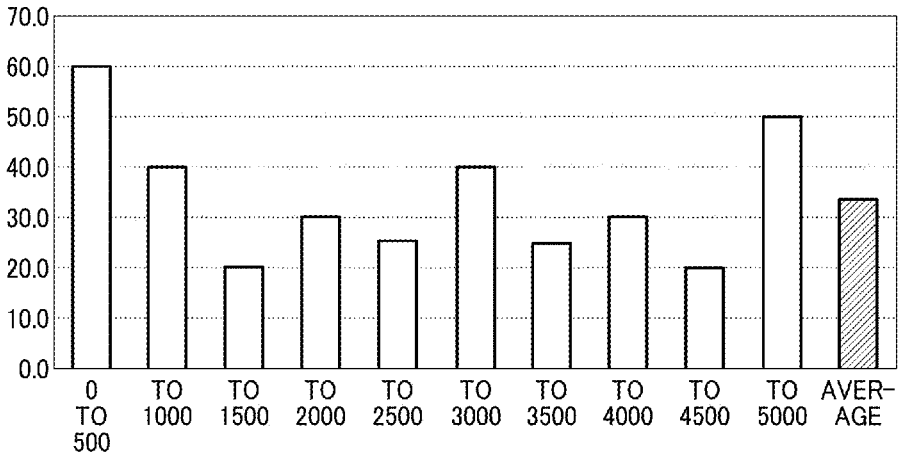

Referring to FIGS. 9A and 9B, for example, the image forming apparatus 1 stores temperature inside the image forming apparatus 1, detected by the environment sensor 201, every working hour in recent five days, and the average temperature is used as the operating condition data. Alternatively, as illustrated in FIGS. 9C and 9D, the smoothness of each of 5,000 sheets on which images are printed recently is stored, and an average smoothness is used as the operating condition data.

Additionally, in the present embodiment, the term "predetermined criterion (or criteria)" means a reference operating condition for the switching determiner 393 to determine that the image forming apparatus 1 is under harsh conditions, such as hot and humid conditions. When the operating condition satisfies the predetermined criterion, the switching determiner 393 determines that the image forming apparatus 1 is under harsh conditions.

For example, as the temperature and the humidity inside the image forming apparatus 1 increase, the possibility of aggregation of toner and paper dust increases. For example, in FIG. 10A, the predetermined criteria are a temperature inside the apparatus of 35° C. or higher and a humidity inside the apparatus of 70% or higher. When the temperature and the humidity inside the apparatus satisfy the predetermined criteria, the switching determiner 393 determines that the image forming apparatus 1 is under harsh conditions and selects the determination type A to determine the switching between disposal and reuse. By contrast, in FIG. 10A, when the temperature inside the apparatus is lower than 35° C. and the humidity inside the apparatus is lower than 70%, the switching determiner 393 determines that the image forming apparatus 1 is not under harsh conditions and selects the determination type B to determine the switching.

Additionally, for example, the amount of paper dust and the temperature inside the apparatus increase as the number of printed sheets per day increases. Accordingly, in FIG. 10B, the predetermined criterion is the number of printed sheets per day in three days preceding immediately. For example, when the number of printed sheets per day in preceding three days is 5,000 or greater, the switching determiner 393 determines that the image forming apparatus 1 is under harsh conditions and selects the determination type A to determine the switching between disposal and reuse. By contrast, in FIG. 10B, when the number of printed sheets per day in preceding three days is less than 5,000, the switching determiner 393 determines that the image forming apparatus 1 is not under harsh conditions and selects the determination type B to determine the switching.

Additionally, for example, the amount of paper dust also increases as the accumulated number of printed sheets increases. Accordingly, in FIG. 10C, the predetermined criterion is the accumulated number of printed sheets. For example, when the accumulated number of printed sheets is 40,000 or greater, the switching determiner 393 determines that the image forming apparatus 1 is under harsh conditions and selects the determination type A to determine the switching between disposal and reuse. By contrast, in FIG. 10C, when the accumulated number of printed sheets is less than 40,000, the switching determiner 393 determines that the image forming apparatus 1 is not under harsh conditions and selects the determination type B to determine the switching.

Additionally, when duplex printing is executed, the sheet once heated to fix an image thereon is again transported through the apparatus, and thus temperature inside the apparatus increases. Accordingly, in FIG. 10D, the predetermined criterion is the rate of duplex printing. For example, when the rate of duplex printing is 30% or greater, the switching determiner 393 determines that the image forming apparatus 1 is under harsh conditions and selects the determination type A to determine the switching between disposal and reuse. By contrast, in FIG. 10D, when the rate of duplex printing is less than 30%, the switching determiner 393 determines that the image forming apparatus 1 is not under harsh conditions and selects the determination type B to determine the switching.

Additionally, for example, when the length of unused time from the previous operation is relatively short, it means that the image forming apparatus 1 is used relatively frequently. Accordingly, in FIG. 10E, the predetermined criterion is the length of unused time. For example, when the length of unused time is shorter than 30 minutes, the switching determiner 393 determines that the image forming apparatus 1 is under harsh conditions and selects the determination type A to determine the switching between disposal and reuse. By contrast, in FIG. 10E, when the length of unused time is 30 minutes or longer, the switching determiner 393 determines that the image forming apparatus 1 is not under harsh conditions and selects the determination type B to determine the switching.

Figure 11:
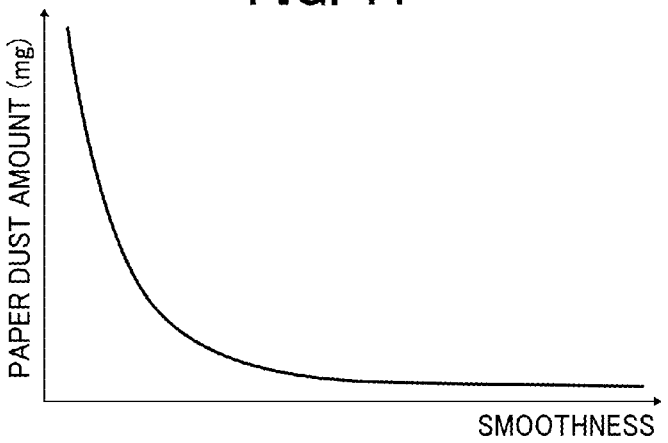
FIG. 11 is a graph of relation between the amount of paper dust mixed with toner inside a developing device and smoothness of transfer sheets.

Additionally, as illustrated in FIG. 11, the amount of paper dust also increases as the smoothness of the sheet becomes lower. Accordingly, in FIG. 10F, the predetermined criterion is the average smoothness of sheets used in image formation in a given period or the average smoothness of a predetermined number of sheets. For example, when the average smoothness is lower than 30, the switching determiner 393 determines that the image forming apparatus 1 is under harsh conditions and selects the determination type A to determine the switching between disposal and reuse. By contrast, in FIG. 10F, when the average smoothness is 30 or higher, the switching determiner 393 determines that the image forming apparatus 1 is not under harsh conditions and selects the determination type B to determine the switching.

The setting data memory 394 stores various types of setting data used in the switching control and the determination type selection made by the switching determiner 393. The setting data memory 394 is implemented by the volatile storage medium such as the ROM 30 and the HDD 40 illustrated in FIG. 1.

The toner replacement data collector 395 collects and stores the toner replacement data. The operating condition data collector 396 collects and stores the operating condition data.

Next, descriptions are given below of determination type selection made in the image forming apparatus 1 according to the present embodiment with reference to FIG. 12.

Figure 12:
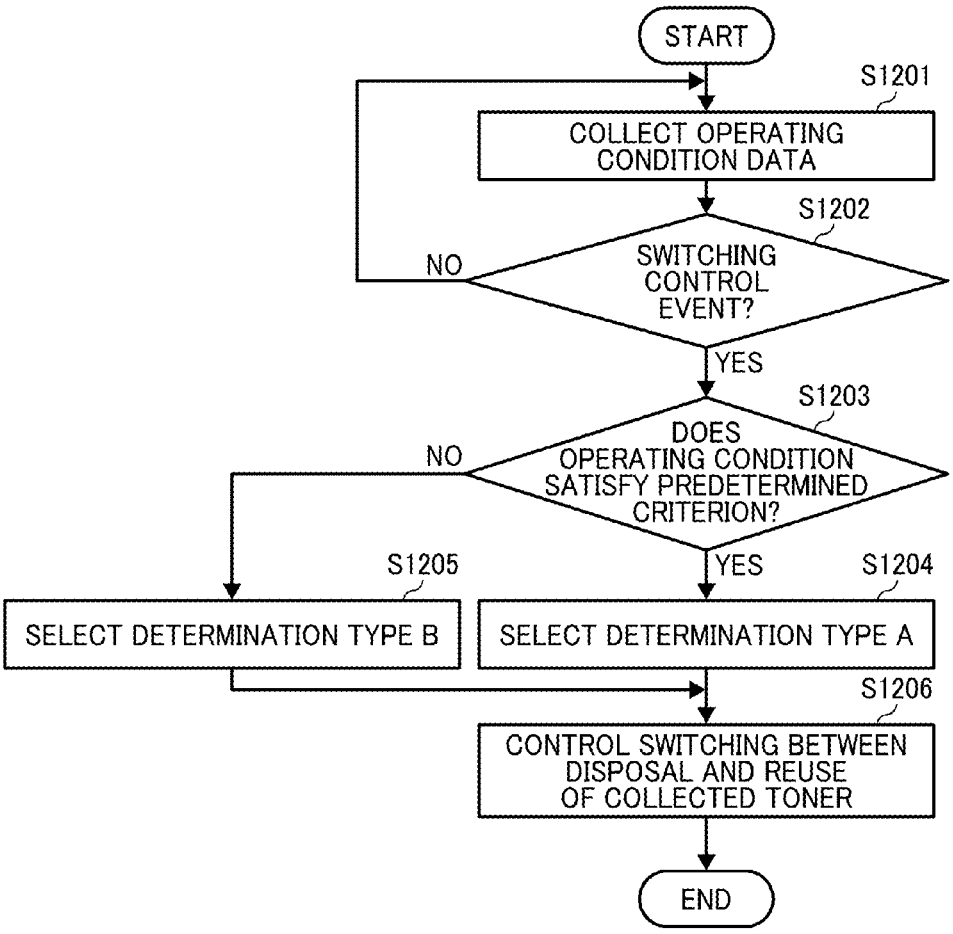
FIG. 12 is a flowchart of determination type selection according to an embodiment.

FIG. 12 is a flowchart of determination type selection made in the image forming apparatus 1.

In the determination type selection according to the present embodiment, at S1201, the operating condition data collector 396 collects the operating condition data while there is no event (i.e., a switching control event) for the determination type selection and the switching control.

When the switching control event occurs (Yes at S1202), at S1203, the switching determiner 393 determines whether or not the operating condition satisfies the predetermined criterion based on the operating condition data collected until then.

It is to be noted that the switching control event includes, for example, the start of printing, the end of printing, an adjustment operation, a predetermined length of unused time, accumulation of number of sheets printed to a predetermined number, and the occurrence of cause of changes in operating condition. Operating conditions can vary at those timings. Controlling the switching of conveyance route of collected toner in accordance with the variable operating conditions relatively frequently is advantageous in that a current operating condition is reflected in the switching control.

Accordingly, in the present embodiment, the switching is controlled in accordance with the operating conditions. With this configuration, handling of collected toner is properly switched between disposed and reused. Accordingly, the image forming apparatus 1 according to the present embodiment attains both of advantages of reuse of developer, such as reductions of environmental impact, running cost of the apparatus, and complexity of maintenance and management, and image quality guarantee.

Determining that the operating condition satisfies the predetermined criterion (Yes at S1203), the switching determiner 393 selects the determination type A (determination based on the number of printed sheets) for determination of switching between disposal and reuse of collected toner at S1204.

By contrast, determining that the operating condition does not satisfy the predetermined criterion (No at S1203), the switching determiner 393 selects the determination type B (determination based on the toner replacement data) for determination of switching between disposal and reuse of collected toner at S1205.

At S1206, the printing controller 391 controls the switching between disposal and reuse of collected toner in the selected determination type.

Descriptions are given below of the switching between disposal and reuse of collected toner in the determination type A, which is based on the number of printed sheets.

Figure 13:
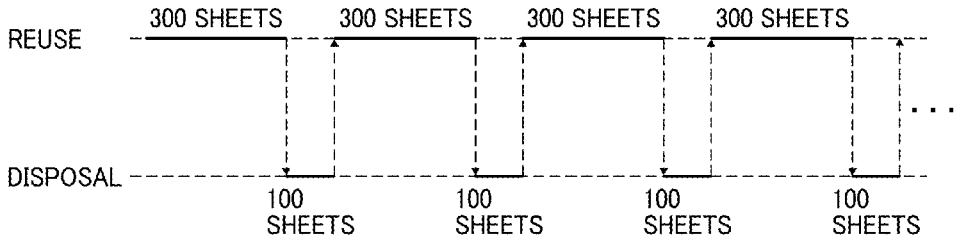
FIG. 13 is a chart of switching between disposal and reuse of collected toner in a first determination type according to an embodiment.

FIG. 13 is a chart of the determination type A for controlling disposal and reuse of collected toner in the image forming apparatus 1.

As illustrated in FIG. 13, when the determination type A is employed, the image forming apparatus 1 switches the route of collected toner between the waste channel 325*h* and the reuse channel 325*i* each time the number of printed sheets reaches an operation amount threshold, that is, at predetermined switching intervals corresponding to the number of printed sheets. It is to be noted that FIG. 13 illustrates an example in which the switching from reuse to disposal occurs when the number of sheets printed reaches 300 (first operating amount threshold) and the switching from disposal to reuse occurs when the number of printed sheets reaches 100 (second operating amount threshold), the switching intervals are not limited thereto.

Specifically, for example, as illustrated in FIG. 13, when the switching determiner 393 determines that the number of sheets printed during reuse of collected toner reaches 300 sheets, the switching determiner 393 determines to dispose the collected toner. According to the determination made by the switching determiner 393, the printing controller 391 switches the collected toner conveyance route to the waste channel 325*h*. That is, the partition shutter 325*j* is closed.

By contrast, as illustrated in FIG. 13, when the switching determiner 393 determines that the number of sheets printed during disposal of collected toner reaches 100, the switching determiner 393 determines to dispose collected toner. According to the determination made by the switching determiner 393, the printing controller 391 switches the collected toner conveyance route to the reuse channel 325*i*. That is, the partition shutter 325*j* is open.

As illustrated in FIG. 13, while the determination type A is employed, the image forming apparatus 1 performs the switching between disposal of collected toner and reuse thereof when the number of printed sheets reaches the threshold. Thus, the present embodiment is advantageous in effectively inhibiting degradation of toner under harsh operating conditions and reducing the amount of waste toner. It is to be noted that, at that time, degradation of toner quality resulting from reused toner is inhibited since the image forming apparatus 1 actively reduces the content of reused toner in the developing device 323.

Descriptions are given below of the switching between disposal and reuse of collected toner in the determination type B, which is based on the toner replacement data.

When the determination type B is employed, initially the switching determiner 393 refers to the toner replacement data and calculates the amount of toner supplied to the developing device 323 from the toner supply assembly 350 and the amount of toner that exits the developing device 323 (consumption). That is, the switching determiner 393 calculates the amount of toner replaced with the supplied toner (hereinafter "replaced toner amount") in the developing device 323.

Then, the switching determiner 393 controls the switching between disposal and reuse to keep the replaced toner amount of toner at or greater than a threshold. Specifically, when the replaced toner amount is greater than the threshold, the switching determiner 393 judges that the toner in the developing device 323 is sufficiently replaced and determines to reuse collected toner. In other words, when the replaced toner amount is greater than the threshold, the switching determiner 393 determines that degradation of toner in the developing device 323 caused by long time agitation does not matter or is small and determines to reuse collected toner.

By contrast, when the replaced toner amount is smaller than the threshold, the switching determiner 393 judges that replacement of toner in the developing device 323 is insufficient and determines to dispose collected toner to promote the replacement of toner. In other words, when the replaced toner amount is smaller than the threshold, the switching determiner 393 determines that degradation of toner in the developing device 323 has progressed due to long time agitation and determines to dispose collected toner. According to the determination made by the switching determiner 393, the printing controller 391 switches the toner collecting device 325 between disposal and reuse of collected toner.

Additionally, for example, when the determination type B is employed, based on the toner replacement data, the switching determiner 393 calculates a required waste amount, meaning an ideal amount of toner to be disposed to keep the quality of toner in the developing device 323 at or higher than a desired quality, and a discharged amount, meaning the amount of toner that has been discharged to the waste-toner container 326. Then, the switching determiner 393 compares the discharged amount with the required waste amount. Then, the switching determiner 393 controls the switching between disposal and reuse according to the result of comparison.

That is, when the discharged amount is smaller than the required waste amount, the switching determiner 393 determines that quality of toner in the developing device 323 is not secured and determines to dispose the collected toner. By contrast, when the discharged amount is greater than the required waste amount, the switching determiner 393 determines that quality of toner in the developing device 323 is secured and determines to reuse the collected toner.

According to the determination made by the switching determiner 393, the printing controller 391 switches the toner collecting device 325 between disposal and reuse of collected toner. It is to be noted that the required waste amount varies depending on the operating conditions. In one embodiment, the required waste amount is adjusted depending on the operating condition data to more properly control the switching between disposed and reuse of collected toner.

Additionally, for example, when the disposal and reused of collected toner is switched according to the determination type B, based on the toner replacement data, the switching determiner 393 compares an ideal toner consumption, meaning an ideal amount of toner to be consumed to secure the quality of toner in the developing device 323 at or higher than the desired quality, with a consumed amount, meaning the amount of toner that has been consumed.

That is, when the consumed amount is smaller than the ideal toner consumption, the switching determiner 393 determines that quality of toner in the developing device 323 is not secured and determines to dispose the collected toner. By contrast, when the consumed amount is greater than the ideal toner consumption, the switching determiner 393 determines that quality of toner in the developing device 323 is secured and determines to reuse the collected toner.

According to the determination made by the switching determiner 393, the printing controller 391 switches the toner collecting device 325 between disposal and reuse of collected toner. It is to be noted that the ideal toner consumption varies depending on the operating conditions. In one embodiment, the ideal toner consumption is adjusted depending on the operating condition data to more properly control the switching between disposed and reuse of collected toner.

Thus, the image forming apparatus 1 switches the route of collected toner between the waste channel **325*h* and the reuse channel 325*i* according to the toner replacement data while the determination type B is employed. Accordingly, the image forming apparatus 1 according to the present embodiment switches the route of collected toner between the waste channel 325*h* and the reuse channel 325*i* to balance inhibition of degradation of toner caused by long time agitation in the developing device 323** and reduction of the amount of waste toner.

As described above, the image forming apparatus 1 according to the present embodiment selects, based on the operating condition data, one of the toner replacement data and the number of printed sheets as the criterion for the switching determination between disposal and reuse of collected toner.

Specifically, determining that the operating condition satisfies the predetermined criterion based on the operating condition data, the image forming apparatus 1 determines that the operating condition is harsh, such as hot and humid conditions, and uses the number of printed sheets for determining the switching between disposal and reuse of collected toner. Accordingly, the image forming apparatus 1 according to the present embodiment executes the switching between disposal and reuse of collected toner to balance inhibition of degradation of toner caused by harsh operating conditions and reduction of the amount of waste toner. It is to be noted that, at that time, degradation of toner quality resulting from reused toner is inhibited since the image forming apparatus 1 actively reduces the content of reused toner in the developing device 323.

By contrast, when the operating condition does not satisfy the predetermined criterion, the image forming apparatus 1 determines that the operating condition is not harsh and uses the toner replacement data for determining the switching. Accordingly, the image forming apparatus 1 according to the present embodiment switches the route of collected toner between the waste channel **325*h* and the reuse channel 325*i* to balance inhibition of degradation of toner caused by long time agitation in the developing device 323** and reduction of the amount of waste toner.

With this configuration, route of collected toner is properly switched between disposed and reused. Accordingly, the image forming apparatus 1 according to the present embodiment attains both of advantages of reuse of developer, such as reductions of environmental impact, running cost of the apparatus, and complexity of maintenance and management, and image quality guarantee.

It is to be noted that the description above concerns controlling the switching between disposal and reuse of collected toner based on the number of printed sheets, as the operating amount, when the operating condition satisfies the predetermined criterion. Alternatively, when the switching determiner 393 determines that the operating condition satisfies the predetermined criterion, the switching is controlled based on, as the operating amount, the driving amount (i.e., rotation speed, rotation distance, driving time, or the like) of a driven component disposed in the toner conveyance passage, such as the developer conveying screws 323*a* and 323*b*, the developing roller 323*c*, the photoconductor drum 321, and the collected-toner conveying screw 325*b*.

Second Embodiment

In the first embodiment described above, as illustrated in FIG. 13, when the determination type A is employed, the image forming apparatus 1 switches the handling of collected toner between disposal and reuse at the predetermined switching intervals. With this configuration, the switching between disposal and reuse of collected toner is switched to inhibit degradation of toner caused by harsh operating conditions.

The degradation progress of toner in the developing device 323, however, varies depending on the replaced toner amount in the developing device 323. Therefore, adjusting the switching intervals in accordance with the toner replacement data is advantageous in switching the handling of collected toner to inhibit degradation of toner caused by harsh operating conditions more effectively. Therefore, a second embodiment concerns an image forming apparatus that sets the switching intervals in accordance with the toner replacement data when the switching between disposal and reuse of collected toner is determined in the determination type A.

Descriptions are given below of setting the switching intervals based on the toner replacement data. It is to be noted that elements of the present embodiment similar to those of the first embodiment are given identical or similar reference characters, and thus descriptions thereof omitted.

Figure 14:
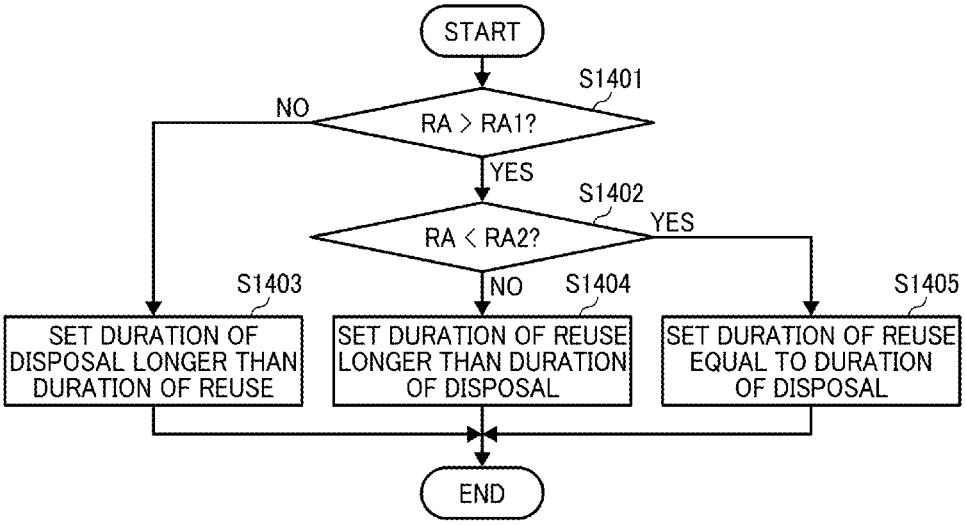
FIG. 14 is a flowchart of setting intervals between switching between disposal and reuse of collected toner based on toner replacement data.

FIG. 14 is a flowchart of processes for setting the switching intervals based on the replaced toner amount given reference "RA", which is represented by the toner replacement data.

For the image forming apparatus 1 to set the switching intervals according to the toner replacement data, at S1401, the switching determiner 393 compares the replaced toner amount RA in the developing device 323 (indicated by the toner replacement data) with a first reference amount RA1. At S1402, the switching determiner 393 compares the replaced toner amount RA with a second reference amount RA2.

The first reference amount RA1 serves as a criterion for the switching determiner 393 to determine that the replaced toner amount RA in the developing device 323 is small. The switching determiner 393 determines that the replaced toner amount RA in the developing device 323 is small when the replaced toner amount RA is equals to or smaller than the first reference amount RA1 (RA>RA1).

The second reference amount RA2 serves as a criterion for the switching determiner 393 to determine that the replaced toner amount RA in the developing device 323 is large. The switching determiner 393 determines that the replaced toner amount RA in the developing device 323 is large when the replaced toner amount RA is equals to or greater than the second reference amount RA2.

By contrast, the switching determiner 393 determines that the replaced toner amount RA in the developing device 323 is neither large nor small when the replaced toner amount RA falls between the first reference amount RA1 the second reference amount RA2.

For example, the replaced toner amount RA is smaller when the image area ratio is lower, and replaced toner amount RA is greater when the image area ratio is higher. Accordingly, for example, when the image area ratio is lower than 3%, which serves as the first reference amount RA1, the switching determiner 393 determines that the replaced toner amount RA in the developing device 323 is small. In this case, since the replaced toner amount RA should be increased, the switching determiner 393 determines to give priority to disposal of collected toner over reuse of collected toner. In other words, in this case, the switching determiner 393 determines that degradation of toner in the developing device 323 has progressed due to long time agitation and determines to give priority to disposal.

By contrast, for example, when the image area ratio is greater than 4%, which serves as the second reference amount RA2, the switching determiner 393 determines that the replaced toner amount RA is equal to or greater than the second reference amount RA2 and determines that the replaced toner amount RA in the developing device 323 is sufficient. In this case, it is not necessary to increase the replaced toner amount RA, and the switching determiner 393 determines to give priority to reuse of collected toner over disposal. In other words, in this case, the switching determiner 393 determines that toner in the developing device 323 is not degraded by long time agitation and determines to give priority to reuse.

By contrast, for example, when the image area ratio is 3.5%, the switching determiner 393 determines that the replaced toner amount RA is between the first reference amount RA1 (e.g., 3%) and the second reference amount RA2 (e.g., 4%) and the replaced toner amount RA is neither large nor small. In other words, in this case, the switching determiner 393 determines that degradation of toner in the developing device 323 by long time agitation is small and determines to perform disposal and reuse of collected toner at equal rate.

Figure 15:
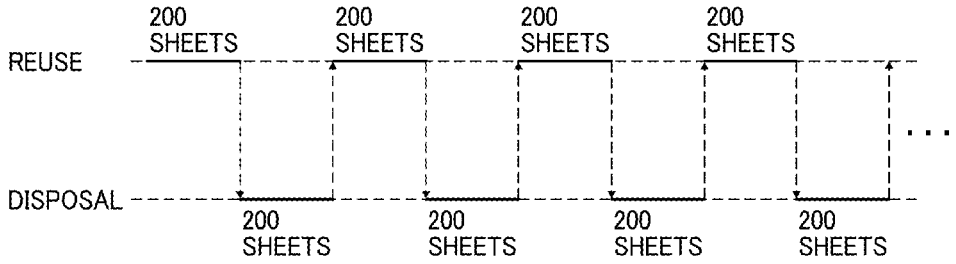
FIG. 15 is a chart of intervals between the switching according to an embodiment.

Referring back to FIG. 14, when the replaced toner amount RA is greater than the first reference amount RA1 (RA>RA1, Yes at S1401) and smaller than the second reference amount RA2 (RA<RA2, Yes at S1402), at S1405, the switching determiner 393 sets the switching interval such that the switching to disposal and the switching to reuse occur at equal intervals (duration of reuse is equal to duration of disposal). Thus, the present embodiment is advantageous in effectively inhibiting degradation of toner under harsh operating conditions. For example, as illustrated in FIG. 15, the switching determiner 393 sets the number of printed sheets corresponding to the switching interval from reuse to disposal to 200 (first operating amount threshold) and the number of printed sheets corresponding to the switching interval from disposal to reuse to 200 (second operating amount threshold).

Figure 16:
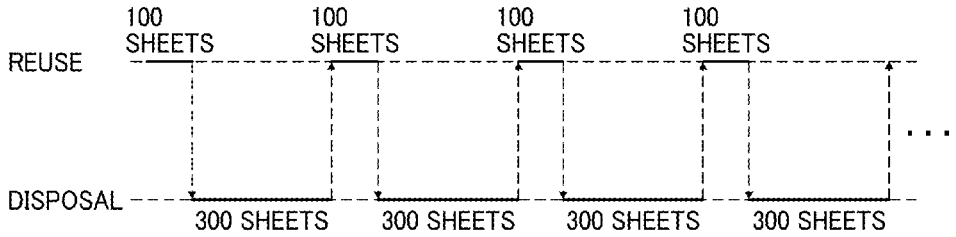
FIG. 16 is a chart of intervals between the switching according to an embodiment.

When the replaced toner amount RA is equal to or smaller than the first reference amount RA1 (RA≤RA1, No at S1401), at S1403, the switching determiner 393 sets the switching interval to make the duration of disposal longer than the duration of reuse. Thus, the present embodiment is advantageous in effectively inhibiting degradation of toner under harsh operating conditions. For example, as illustrated in FIG. 16, the switching determiner 393 sets the number of printed sheets corresponding to the switching interval from reuse to disposal to 100 (first operating amount threshold) and that from disposal to reuse to 300 (second operating amount threshold). Alternatively, for example, the switching determiner 393 sets the switching intervals such that the collected toner is constantly disposed.

Figure 17:
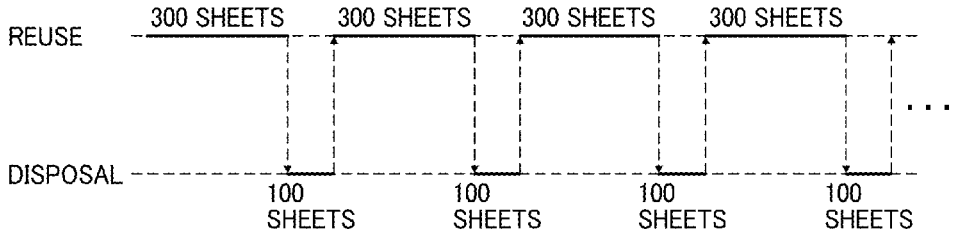
FIG. 17 is a chart of intervals between the switching according to an embodiment.

By contrast, when the replaced toner amount RA is equal to or greater than the second reference amount RA2 (RA≥RA2, No at S1402), at S1404, the switching determiner 393 sets the switching interval to make the duration of reuse longer than the duration of disposal. Thus, the present embodiment is advantageous in more effectively inhibiting degradation of toner under harsh operating conditions and reducing the amount of waste toner. For example, as illustrated in FIG. 17, the switching determiner 393 sets the number of printed sheets corresponding to the switching interval from reuse to disposal to 300 (first operating amount threshold) and that from disposal to reuse to 100 (second operating amount threshold).

As described above, in the second embodiment, when the switching between disposal and reuse of collected toner is controlled in the determination type A, the switching intervals are set according to the toner replacement data. Accordingly, the switching between disposal and reuse of collected toner is performed to more effectively inhibit degradation of toner caused by harsh operating conditions and reduce the amount of waste toner.

It is to be noted that, although the switching intervals are set according to the result of comparison between the replaced toner amount RA with the first and second reference amounts RA1 and RA2 in the description above, alternatively, the switching intervals are set stepwise according to the replaced toner amount RA.

Third Embodiment

In the first embodiment described above, as illustrated in FIG. 13, when the determination type A is employed, the image forming apparatus 1 switches the handling of collected toner between disposal and reuse at the predetermined switching intervals. With this configuration, the switching between disposal and reuse of collected toner is switched to inhibit degradation of toner caused by harsh operating conditions.

In the second embodiment described above, as illustrated in FIG. 14, when the determination type A is employed, the image forming apparatus 1 sets the switching intervals in accordance with the toner replacement data. With this configuration, the switching between disposal and reuse of collected toner is switched to effectively inhibit degradation of toner caused by harsh operating conditions.

The degradation progress of toner in the developing device 323, however, varies depending on the operating conditions. Therefore, adjusting the switching intervals in accordance with the operating condition data is advantageous in switching the handling of collected toner to inhibit degradation of toner caused by harsh operating conditions more effectively. Therefore, a third embodiment concerns an image forming apparatus that sets the switching intervals in accordance with the operating condition data when the switching between disposal and reuse of collected toner is determined in the determination type A.

Descriptions are given below of setting the switching intervals based on the operating condition data with reference to FIGS. 18A through 18D.

It is to be noted that elements similar to those of the first and second embodiments are given identical or similar reference characters, and thus descriptions thereof omitted.

FIGS. 18A through 18D are charts of setting the switching intervals based on the operating condition data.

Figure 18A:
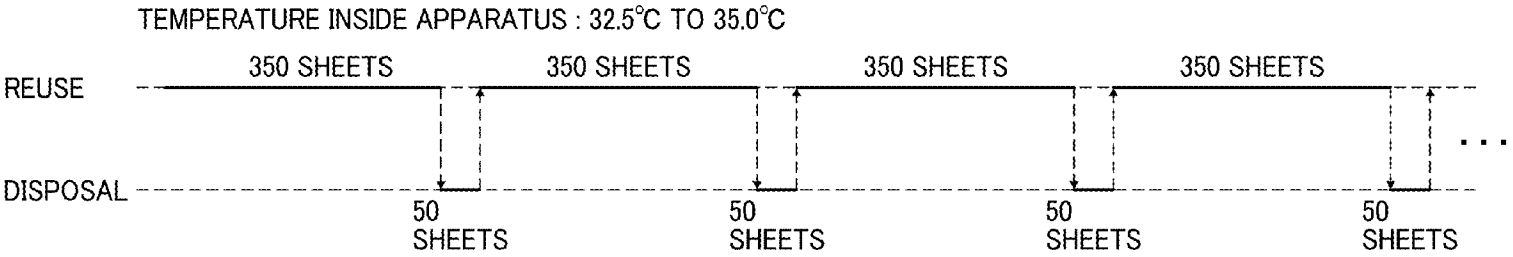
FIGS. 18A through 18D are charts of intervals between the switching according to an embodiment.
Figure 18B:
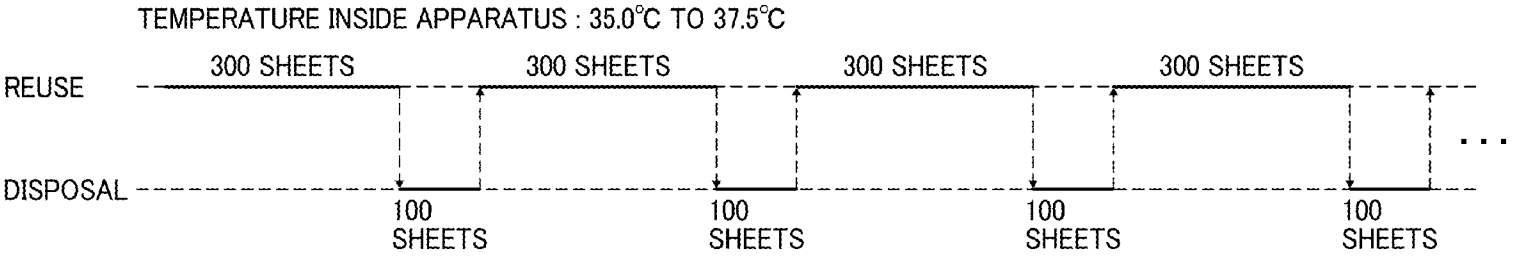
Figure 18C:
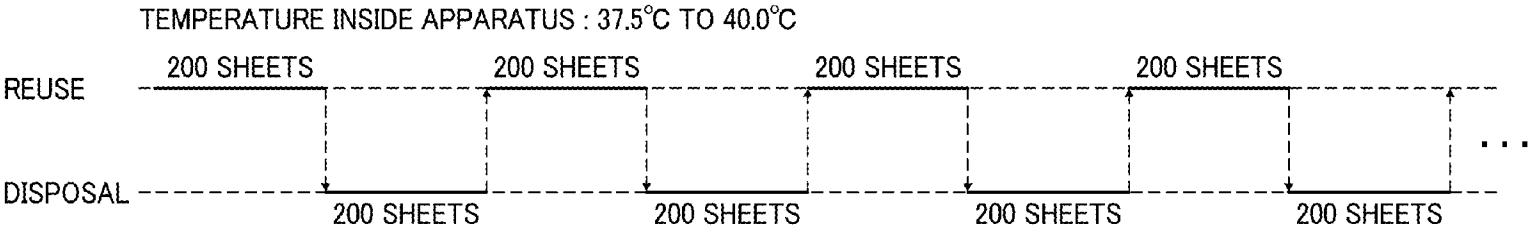
Figure 18D:
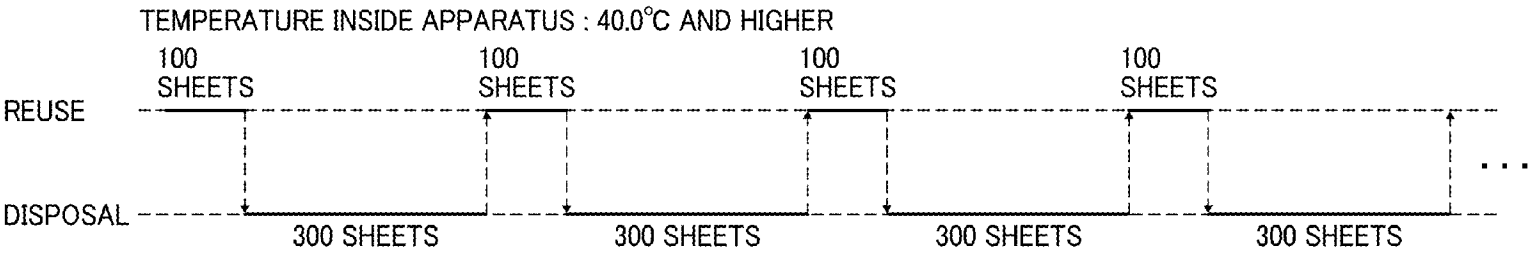

It is to be noted that, although the temperature inside the apparatus is used as the operating condition data in FIG. 18A thorough FIG. 18D, the switching intervals are set in similar manner when other operating condition data is used.

As illustrated in FIGS. 18A through 18D, the switching determiner 393 according to the present embodiment sets the switching intervals stepwise based on the operating condition data.

That is, as the harshness of operating condition increases, the switching determiner 393 determines that the degradation progress of toner increases and sets the switching intervals to give priority to disposal of collected toner over reuse thereof.

For example, as illustrated in FIG. 18A, when the temperature inside the apparatus, serving as the operating condition, is within a range of 32.5° C. to 35.0° C., the switching determiner 393 sets the number of printed sheets corresponding to the switching interval from reuse to disposal to 350 and that from disposal to reuse to 50.

Alternatively, for example, as illustrated in FIG. 18B, when the temperature inside the apparatus, serving as the operating condition, is within a range of 35.0° C. to 37.5° C., the switching determiner 393 sets the number of printed sheets corresponding to the switching interval from reuse to disposal to 300 and that from disposal to reuse to 100.

Alternatively, for example, as illustrated in FIG. 18C, when the temperature inside the apparatus, serving as the operating condition, is within a range of 37.5° C. to 40.0° C., the switching determiner 393 sets the number of printed sheets corresponding to the switching interval from reuse to disposal to 200 and that from disposal to reuse to 200.

Alternatively, for example, as illustrated in FIG. 18D, when the temperature inside the apparatus, serving as the operating condition, is 40.0° C. or higher, the switching determiner 393 sets the number of printed sheets corresponding to the switching interval from reuse to disposal to 100 and that from disposal to reuse to 300.

As described above, in the third embodiment, when the switching between disposal and reuse of collected toner is controlled in the determination type A, the switching intervals are set according to the operating condition data. Accordingly, the switching between disposal and reuse of collected toner is performed to more effectively inhibit degradation of toner caused by harsh operating conditions and reduce the amount of waste toner.

In another embodiment, when the switching between disposal and reuse of collected toner is controlled in the determination type A, the switching intervals are set according to both of the toner replacement data and the operating condition data.

The steps in the above-described flowchart may be executed in an order different from that in the flowchart.

Further, elements and/or features of different example embodiments may be combined with each other and/or substituted for each other within the scope of this disclosure and appended claims Still further, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image bearer to bear a latent image;

a developing device to develop the latent image with developer;

a transfer device to transfer a developed image from the image bearer onto a recording medium;

a waste-developer container to contain developer to be disposed;

a developer collecting device to collect developer from the image bearer, the developer collecting device including:

a collected-developer conveyor to transport collected developer collected from the image bearer in the developer collecting device, a waste channel leading to the waste-developer container, a reuse channel through which the collected developer for reuse is transported, and a channel switching member to switch a collected developer route between the waste channel and the reuse channel;

a switching determiner to determine whether to dispose or reuse the collected developer;

an operating condition data collector to collect and store operating condition data used as a degradation speed index of developer in the developing device;

a determination type selector to select, according to the degradation speed index collected by the operating condition data collector, a determination type used in determination of whether to dispose or reuse the collected developer from:

a first determination type based on an operating amount of the image forming apparatus, and a second determination type based on developer replacement data indicating an amount of developer replaced with supplied developer in the developing device; and a switching controller to control the channel switching member according to determination made by the switching determiner, wherein the determination type selector is configured to select the first determination type when the degradation speed index indicates that the degradation speed is equal to or relatively higher than a threshold, and wherein the determination type selector is configured to select the second determination type when the degradation speed index indicates that the degradation speed is relatively lower than the threshold.

2. The image forming apparatus according to claim 1, wherein the operating amount is represented by one of:

a number of recording media onto which developed images are transferred; and a driving amount of a driven component disposed in a developer conveyance passage starting from the image bearer and extending in the developer collecting device, wherein the operating amount is measured respectively in a state in which the collected developer route is switched to the reuse channel and a state in which the collected developer route is switched to the waste channel.

3. The image forming apparatus according to claim 1, wherein the developer replacement data includes at least one of a driving amount of a driven component of the developing device, a driving amount of the collected-developer conveyor, a pattern of an image to be output, an image area of the developed image, an amount of developer supplied from the developing device to the image bearer, an amount of developer transferred onto the recording medium, a transfer rate of the developed image transferred from the image bearer onto the recording medium, an amount of unused developer supplied to the developing device, a duration of supply of unused developer to the developing device, an amount of developer disposed in the waste-developer container, and sheet type data indicating a property of the recording medium, and the degradation speed index includes at least one of temperature inside the image forming apparatus, ambient temperature, humidity inside the image forming apparatus, ambient humidity, a number of recording media onto which developed images are transferred; a driving amount of a driven component of the developing device, a driving amount of the image bearer, a rate of duplex printing, a length of unused time of the image forming apparatus from a previous operation, and the sheet type data.

4. The image forming apparatus according to claim 1, wherein, in the first determination type, the switching determiner determines to switch the collected developer route from the reuse channel to the waste channel when the operating amount during reuse of the collected developer reaches a first operating amount threshold and switch the collected developer route from the waste channel to the reuse channel when the operating amount during disposal of the collected developer reaches a second operating amount threshold, and the switching determiner adjusts, according to the developer replacement data, the first operating amount threshold and the second operating amount threshold.

5. The image forming apparatus according to claim 1, wherein, in the first determination type, the switching determiner determines to switch the collected developer route from the reuse channel to the waste channel when the operating amount during reuse of the collected developer reaches a first operating amount threshold and switch the collected developer route from the waste channel to the reuse channel when the operating amount during disposal of the collected developer reaches a second operating amount threshold, and the switching determiner adjusts, according to the degradation speed index, the first operating amount threshold and the second operating amount threshold.

6. The image forming apparatus according to claim 1, wherein the operating condition data collector stores a history of the degradation speed index, and the determination type selector selects either the first determination type or the second determination type according to the history of the degradation speed index.

7. The image forming apparatus according to claim 1, wherein the determination type selector selects either the first determination type or the second determination type upon an occurrence of an event to change the degradation speed index.

8. The image forming apparatus according to claim 7, wherein the event to change the degradation speed index includes at least one of a start of image output, an end of image output, an adjustment operation, and a predetermined length of unused time of the image forming apparatus.

9. The image forming apparatus according to claim 1, further comprising an ambient temperature and humidity sensor to detect ambient temperature and ambient humidity, wherein the degradation speed index includes the ambient temperature and the ambient humidity detected by the ambient temperature and humidity sensor.

10. The image forming apparatus according to claim 1, further comprising a waste developer sensor to detect an amount of developer disposed in the waste-developer container, wherein the developer replacement data includes at least one of an image area of the developed image, a driving amount of a driven component of the developing device, a driving amount of the image bearer, and the amount of developer disposed in the waste-developer container, detected by the waste developer sensor.

11. A method of switching a collected developer route in an image forming apparatus, the method comprising:

collecting developer from an image bearer;

selecting, according to a degradation speed index indicating a degradation speed of developer in a developing device, a determination type used in determination of whether to dispose or reuse collected developer collected from the image bearer from:

a first determination type based on an operating amount of the image forming apparatus, and a second determination type based on developer replacement data indicating an amount of developer replaced with supplied developer in the developing device;

determining whether to dispose or reuse the collected developer route in the determination type selected; and switching the collected developer route between a waste channel and a reuse channel according to the determining, wherein the selecting includes selecting the first determination type when the degradation speed index indicates that the degradation speed is equal to or relatively higher than a threshold, and wherein the selecting includes selecting the second determination type when the degradation speed index indicates that the degradation speed is relatively lower than the threshold.

12. An image forming apparatus comprising:

a channel switching member to switch between a first channel leading to a waste toner container and a second channel leading to a developing device;

an operating condition data collector to collect and store operating condition data;

a determination type selector to select a determination type from:

a first determination type based on an operating amount of the image forming apparatus, and a second determination type based on a developer replacement data; and a switching controller to control the channel switching member according to a determination type selected by the determination type selector, wherein the determination type selector is configured to select the first determination type when the operating condition data satisfies a criterion, and wherein the determination type selector is configured to select the second determination type when the operating condition data does not satisfy the criterion.

13. The image forming apparatus according to claim 12, wherein the operating amount is represented by one of:

a number of recording media onto which developed images are transferred; and a driving amount of a driven component disposed in a developer conveyance passage starting from an image bearer and extending in a toner collecting device, useable to collect toner from the image bearer, the toner collecting device including the channel switching member, the first channel and the second channel, wherein the operating amount is measured respectively in a state in which the first channel is switched to the second channel and a state in which the second channel is switched to the first channel.

14. The image forming apparatus according to claim 12, wherein the developer replacement data includes at least one of a driving amount of a driven component of the developing device, a driving amount of a collected-developer conveyor, a pattern of an image to be output, an image area of a developed image, an amount of toner supplied from the developing device to an image bearer useable to bear a latent image, an amount of toner transferred onto a recording medium, a transfer rate of the developed image transferred from the image bearer onto the recording medium, an amount of unused toner supplied to the developing device, a duration of supply of unused toner to the developing device, an amount of toner disposed in the waste toner container, and sheet type data indicating a property of the recording medium.

15. The image forming apparatus according to claim 12, wherein the operating condition data includes at least one of temperature inside the image forming apparatus, ambient temperature, humidity inside the image forming apparatus, ambient humidity, a number of recording media onto which developed images are transferred; a driving amount of a driven component of the developing device, a driving amount of the image bearer, a rate of duplex printing, a length of unused time of the image forming apparatus from a previous operation, and the sheet type data.

16. The image forming apparatus according to claim 12, wherein the operating condition data collector stores a history of a degradation speed index including degradation speed index and wherein a determination type is selected by the determination type selector according to operating condition data, including degradation speed index, collected by the operating condition data collector, and the determination type selector is configured to select either the first determination type or the second determination type according to the history of the degradation speed index.

17. The image forming apparatus according to claim 12, wherein the determination type selector is configured to select either the first determination type or the second determination type upon an occurrence of an event to change the operating condition data.

18. The image forming apparatus according to claim 17, wherein the event to change the operating condition data includes at least one of a start of image output, an end of image output, an adjustment operation, and a length of unused time of the image forming apparatus.

19. The image forming apparatus according to claim 12, further comprising an ambient temperature and humidity sensor to detect ambient temperature and ambient humidity, wherein the operating condition data includes the ambient temperature and the ambient humidity detected by the ambient temperature and humidity sensor.

20. The image forming apparatus according to claim 12, further comprising a waste toner sensor to detect an amount of toner disposed in the waste-toner container, wherein the developer replacement data includes at least one of an image area of a developed image, a driving amount of a driven component of a developing device to develop the image, a driving amount of an image bearer to bear the image, and the amount of toner disposed in the waste-toner container, detected by the waste toner sensor.

* * * * *